US006863458B2

(12) United States Patent
Konishi et al.

(10) Patent No.: US 6,863,458 B2
(45) Date of Patent: Mar. 8, 2005

(54) TAPE PRINTING APPARATUS AND DATA INPUT PROCESSING METHOD THEREFOR

(75) Inventors: Yoshiharu Konishi, Shiojiri (JP); Kiyoshi Ogawa, Tokyo (JP); Takuya Suetani, Tokyo (JP); Tomoki Nakamura, Tokyo (JP); Yasuhide Anbiru, Tokyo (JP); Shinji Ishizuka, Tokyo (JP)

(73) Assignees: Seiko Epson Corporation, Tokyo (JP); King Jim Co., Ltd., Tokyo (JP)

( * ) Notice: Subject to any disclaimer, the term of this patent is extended or adjusted under 35 U.S.C. 154(b) by 138 days.

(21) Appl. No.: 10/234,450

(22) Filed: Sep. 3, 2002

(65) Prior Publication Data

US 2003/0059244 A1 Mar. 27, 2003

(30) Foreign Application Priority Data

Sep. 3, 2001 (JP) ..... 2001-265857

(51) Int. Cl.[7] ..... B41J 3/46; B41J 15/00

(52) U.S. Cl. ..... 400/611; 400/613; 400/615.2

(58) Field of Search ..... 400/611, 613–615.2; 101/288

(56) References Cited

U.S. PATENT DOCUMENTS 5,559,934 A * 9/1996 Ogura et al. ..... 358/1.18
5,651,619 A * 7/1997 Nunokawa et al. ..... 400/83
6,485,208 B2 * 11/2002 Woodman et al. ..... 400/615.2

FOREIGN PATENT DOCUMENTS

| | | | | |
|---|---|---|---|---|
| JP | 04-105980 | | 4/1992 | |
| JP | 05177883 | A * | 7/1993 | ..... B41J/5/30 |
| JP | 06-032031 | | 2/1994 | |
| JP | 07-164712 | | 6/1995 | |
| JP | 07251531 | A * | 10/1995 | ..... B41J/3/36 |
| JP | 07251532 | A * | 10/1995 | ..... B41J/3/36 |
| JP | 2546196 | | 8/1996 | |
| JP | 2556231 | | 9/1996 | |
| JP | 10329384 | A * | 12/1998 | ..... B41J/21/00 |

OTHER PUBLICATIONS

Machine translation of JP 05177883 from the Japanese Patent Office website.*

* cited by examiner

*Primary Examiner*—Daniel J. Colilla
(74) *Attorney, Agent, or Firm*—Hogan & Hartson, LLP

(57) ABSTRACT

There are provided a tape printing apparatus that is capable of enhancing the operability thereof in inputting text data by providing an edit area aside from a text data input area where text data can be input, on a display screen, and a data input processing method therefor. The inputted data is recognized in a manner distinguishing between data within the maximum printable number of lines and data in excess of the maximum printable number of lines. Of the inputted data, there are displayed not only the data recognized to be within the maximum printable number of lines but also data of a predetermined number of lines in excess of the maximum printable number of lines.

41 Claims, 15 Drawing Sheets

CUT & PASTE FUNCTION

FIG. 14A

TAPE WIDTH AND MAXIMUM PRINTABLE NUMBER OF LINES
(TAPE WIDTH-DEPENDENT MAXIMUM NUMBER OF LINES)

| TAPE WIDTH | MAXIMUM PRINTABLE NUMBER OF LINES |
|---|---|
| 6 | 2 |
| 9 | 3 |
| 12 | 5 |
| 18 | 7 |
| 24 | 10 |
| 36 | 13 |

FIG. 14B

WIDTH OF PRINT HEAD AND MAXIMUM PRINTABLE NUMBER OF LINES
(HEAD WIDTH-DEPENDENT MAXIMUM NUMBER OF LINES)

| WIDTH OF PRINT HEAD (mm) | MAXIMUM PRINTABLE NUMBER OF LINES |
|---|---|
| 27 | 13 (CORRESPONDS TO MAXIMUM TAPE WIDTH OF 36 mm) |

TAPE PRINTING APPARATUS AND DATA INPUT PROCESSING METHOD THEREFOR

BACKGROUND OF THE INVENTION

1. Field of the Invention

This invention relates to a tape printing apparatus that is capable of printing one to a plurality of lines on a tape based on inputted data, and a data input processing method therefor.

2. Prior Art

Recently, a tape printing apparatus has been proposed which enables a user to edit and produce text data by operating a keyboard or the like while viewing a liquid crystal display, and performs printing on a tape based on the text data. In the tape printing apparatus of this kind, a maximum printable number of lines is determined based on the width of a print head or the width of a tape, and when the user produces text data in excess of the maximum printable number of lines, the user is notified of occurrence of an error. For example, assuming that the maximum number of lines determined based on the width of a tape is four, if four or more lines of text data are to be produced (if a new line start key is depressed four or more times), an error message is displayed on a display, or an alarm is issued to notify the user of occurrence of an error.

In the tape printing apparatus described above, however, it is impossible to input data in excess of the maximum of four lines, and hence on the display as well, text data is inhibited from being inputted in excess of four lines. Therefore, even if the user desires to input data only for editing purposes (e.g. for trial input) aside from inputting the data to a text data input area where data to be printed on a tape can be input (area for storing four lines, in the present case), the user cannot perform such entry of data since there is not provided any area for data input other than the text data input area.

SUMMARY OF THE INVENTION

It is an object of the invention to provide a tape printing apparatus that is capable of enhancing the operability thereof in inputting text data by providing an edit area aside from a text data input area where text data can be inputted, on a display screen, and a data input processing method therefor.

To attain the above object, according to a first aspect of the invention, there is provided a tape printing apparatus that is capable of printing a maximum printable number of lines including one line on a tape based on inputted data.

The tape printing apparatus according to the first aspect of the invention is characterized by comprising:

input means for inputting data;

data-recognizing means for recognizing the data inputted by the input means in a manner distinguishing between data within the maximum printable number of lines and data in excess of the maximum printable number of lines; and display means for displaying, of the data inputted by the input means, not only the data recognized to be within the maximum printable number of lines by the data-recognizing means but also data of a predetermined number of lines in excess of the maximum printable number of lines.

To attain the above object, according to a second aspect of the invention, there is provided a data input processing method for a tape printing apparatus that is capable of printing a maximum printable number of lines including one line on a tape based on inputted data.

The data input processing method according to the second aspect of the invention is characterized by comprising the steps of:

inputting data;

recognizing the data inputted in the inputting step in a manner distinguishing between data within the maximum printable number of lines and data in excess of the maximum printable number of lines; and displaying, of the data inputted in the inputting step, not only the data recognized to be within the maximum printable number of lines in the recognizing step but also data of a predetermined number of lines in excess of the maximum printable number of lines.

According to these printing apparatus and data input processing method, not only the data of the inputted data within the maximum printable number of lines but also data of the same for a predetermined number of lines in excess of the maximum printable number of lines can be displayed. In other words, the area for displaying the above predetermined number of lines can be used as an edit area for trial input of data or the like. This makes it possible to enhance the operability of the apparatus in inputting data.

Further, whether or not inputted data is within the maximum printable number of lines may be determined based on whether or not the number of executions of new line-starting operation is equal to or smaller than a number corresponding to the maximum printable number of lines. Alternatively, if the amount of data (number of characters) printable in one line is determined in advance, it may be determined depending on whether or not inputted data is within the maximum amount of data determined by multiplying the amount of data printable in one line by the maximum printable number of lines.

Preferably, the tape printing apparatus further comprises means for unconditionally determining the maximum printable number of lines based on a width of the tape.

According to this preferred embodiment, the maximum printable number of lines is unconditionally determined based on the width of the tape, and hence it is possible to display data of the predetermined number of lines aside from the data determined to be printable on the tape in actual use. More specifically, when tapes having a plurality of tape widths can be used, it is determined whether or not the data can be printed on a tape currently set for use. For example, if the predetermined number of lines is one and the number of lines displayed is five, the user can determine that the number of lines printable on the tape is four (5−1=4).

The tape printing apparatus includes a print head, and preferably, the maximum printable number of lines is unconditionally determined based on a width of the print head.

According to this preferred embodiment, the maximum printable number of lines is unconditionally determined based on the width of the print head, and hence it is possible to always display data for a fixed number of lines irrespective of the width of a tape in use. For example, the print head has a width corresponding to a maximum tape width usable in the apparatus. Therefore, if the maximum printable number of lines is eight (in a case where the maximum tape width is employed), and at the same time a tape is used which has a tape width permitting maximum four lines to be printed thereon, the user can use not only an area for an actually printable number of lines but also an area corresponding to a total sum of four lines (8−4=4) and the predetermined number of lines of the edit area. Accordingly, since data for a fixed number of lines is displayed, the user does not have to be conscious of the number of lines displayable during inputting of data, and a large edit area can be secured when using a tape having a narrow width. This makes it possible to further enhance the operability of the apparatus.

Preferably, the tape printing apparatus further comprises error notification means for notifying a user of occurrence of an error when the data in excess of the maximum printable number of lines is recognized by the data-recognizing means.

According to this preferred embodiment, when inputted data has exceeded the maximum printable number of lines, an error notification is performed. This enables the user to be aware that the data inputted by him is in excess of the maximum printable number of lines when he is inputting the data. This contributes to prevention of useless input of data.

More preferably, the error notification means notifies the user of occurrence of the error by making an electronic sound.

According to this preferred embodiment, an electronic sound, such as a beep sound, is issued to notify the user of occurrence of an error, whereby the user can clearly know that inputted text data has exceeded the maximum printable number of lines.

Preferably, the error notification means notifies the user of occurrence of the error by causing the display means to display characters to the effect that the inputted data has exceeded the maximum printable number of lines.

According to this preferred embodiment, an error message is issued by displaying characters to the effect that the inputted data has exceeded the maximum printable number of lines. This enables the user to determine the kind of an error at a glance without need to refer to an instruction manual or the like.

More preferably, the error notification means notifies the user of occurrence of the error by causing the display means to display the data of the predetermined number of lines in excess of the maximum printable number of lines in a different display mode from a display mode for displaying the data within the maximum printable number of lines.

According to this preferred embodiment, since the data in excess of the maximum printable number of lines is displayed in a different display mode from a display mode for displaying the data within the maximum printable number of lines, there is no need to provide an area for displaying the error. Therefore, even if a display screen capable of displaying only one line is used, it is possible to display an error while displaying inputted data. It should be noted that the different display mode may be any suitable display mode which enables the data in excess of the maximum printable number of lines to be visually distinguished from the data within the maximum printable number of lines, e.g. through decoration, or change in typeface, color or size of a character.

Preferably, the error notification means notifies the user of occurrence of the error by causing the display means to display the data of the predetermined number of lines in excess of the maximum printable number of lines in either half-tone dot meshing or flashing text or in combination of half-tone dot meshing and flashing text.

According to this preferred embodiment, the data in excess of the maximum printable number of lines is displayed in half-tone dot meshing and/or flashing text, so that the user can clearly know that the inputted text data has exceeded the maximum printable number of lines.

Preferably, the display means is configured to display line head-indicating marks for respective lines, and the error notification means notifies the user of occurrence of the error by displaying ones of the line head-indicating marks attached to the data of the predetermined number of lines in excess of the maximum printable number of lines in a different display mode from a display mode for displaying ones of the line head-indicating marks attached to the data within the maximum printable number of lines.

According to this preferred embodiment, line head-indicating marks attached to the data in excess of the maximum printable number of lines are displayed in a different display mode from a display mode for displaying line head-indicating marks attached to the data within the maximum printable number of lines. Therefore, it is possible to display an error message without spoiling the legibility of the inputted data. Further, if the display means is configured such that it can display line head-indicating marks having line numbers written thereon, the user can confirm at a glance to which line he is inputting data during execution of inputting of the data.

Preferably, the tape printing apparatus further comprises input-inhibiting means for inhibiting inputting of data when the data inputted by the input means has exceeded a number of lines determined by adding the predetermined number of lines to the maximum printable number of lines.

According to this preferred embodiment, the inputting of data is inhibited when the data inputted by the input means has exceeded a number of lines determined by adding the predetermined number of lines to the maximum printable number of lines. This leads to prevention of inputting of undisplayable and useless data.

Preferably, the tape printing apparatus further comprises error notification means for notifying a user of occurrence of an error when the inputting of data is inhibited by the input-inhibiting means.

According to this preferred embodiment, since the user is notified of occurrence of an error when the inputting of data is inhibited, the user can recognize that he is inputting undisplayable data.

Preferably, the error notification means notifies the user of occurrence of the error by temporarily stopping the display means from performing display.

According to this preferred embodiment, the display means is stopped from performing display to thereby notify the user of occurrence of an error. This enables the user to clearly recognize that he is inputting undisplayable data.

Preferably, the input means is capable of cutting or copying part of the data of the predetermined number of lines in excess of the maximum printable number of lines to paste the part of the data into the data within the maximum printable number of lines.

According to this preferred embodiment, it is possible to cut and copy part of the data of the predetermined number of lines in excess of the maximum printable number of lines to paste the part of the data into the data within the maximum printable number of lines. This means that data in the edit area can be effectively used to further enhance the operability of the apparatus.

Preferably, the display means is capable of displaying line head-indicating marks for respective lines, and is configured to add a cursor to a portion for operation, and the input means is capable of joining the data in excess of the maximum printable number of lines to an end of data on a last line within the maximum printable number of lines, when data-deleting operation is carried out with the cursor being attached to a first one of the line head-indicating marks for the data in excess of the maximum printable number of lines.

According to this preferred embodiment, if data-deleting operation is carried out with the cursor being attached to the first line head-indicating mark attached to the data in excess of the maximum printable number of lines, the data in excess of the maximum printable number of lines can be joined to the end of data on the last line within the maximum printable number of lines. This enables data in the edit area to be effectively used and thereby further enhances the operability of the apparatus.

Preferably, the data of the predetermined number of lines in excess of the maximum printable number of lines is data of one line.

According to this preferred embodiment, the data of the predetermined number of lines in excess of the maximum printable number of lines is data of one line. This makes it possible to minimize the capacity of a memory device for use in display, while enhancing the operability of the apparatus.

To attain the above object, according to a third aspect of the invention, there is provided a tape printing apparatus that includes a print head and is capable of printing one to a plurality of lines on a tape based on inputted data.

The tape printing apparatus according to the third aspect of the invention is characterized by comprising:

input means for inputting data;

first data-recognizing means for recognizing the data inputted by the input means in a manner distinguishing between data within a first maximum printable number of lines unconditionally determined based on a width of a tape and data in excess of the first maximum printable number of lines;

second data-recognizing means for recognizing the data inputted by the input means in a manner distinguishing between data within a second maximum printable number of lines unconditionally determined based on a width of the print head and data in excess of the second maximum printable number of lines;

display means for displaying, of the data inputted by the input means, not only the data recognized to be within the second maximum printable number of lines by the second data-recognizing means but also data of a predetermined number of lines in excess of the second maximum printable number of lines; and printing means for printing, of the data inputted by the input means, only the data recognized to be within the first maximum printable number of lines by the first data-recognizing means, on the tape.

To attain the above object, according to a fourth aspect of the invention, there is provided a data input processing method for a tape printing apparatus that includes a print head and is capable of printing one to a plurality of lines on a tape based on inputted data.

The data input processing method according to the fourth aspect of the invention is characterized by comprising the steps of:

inputting data;

recognizing the data inputted in the inputting step in a manner distinguishing between data within a first maximum printable number of lines unconditionally determined based on a width of a tape and data in excess of the first maximum printable number of lines;

recognizing the data inputted in the inputting step in a manner distinguishing between data within a second maximum printable number of lines unconditionally determined based on a width of the print head and data in excess of the second maximum printable number of lines;

displaying, of the data inputted in the inputting step, not only the data recognized to be within the second maximum printable number of lines in the second-mentioned recognizing step but also data of a predetermined number of lines in excess of the second maximum printable number of lines; and printing, of the data inputted in the inputting step, only the data recognized to be within the first maximum printable number of lines in the first-mentioned recognizing step, on the tape.

According to these printing apparatus and data input processing method, not only data of the data input within the second maximum printable number of lines determined based on the width of the print head but also data of the same of the predetermined number of lines in excess of the second maximum printable number of lines can be displayed. That is, an area for displaying the above predetermined number of lines can be used as an edit area for trial input of data or the like. This makes it possible to enhance the operability of the apparatus in inputting data.

Further, the inputted data is distinguished between the data within the first maximum printable number of lines determined based on the width of the tape, and the data in excess of the first maximum printable number of lines, and only the data recognized to be within the first maximum printable number of lines is printed on the tape. In other words, printing is carried out only based on data printable on a tape in actual use. This makes it possible to prevent occurrence of a problem that the print head is damaged due to execution of erroneous printing beyond the width of the tape.

Preferably, the tape printing apparatus further comprises first error notification means for notifying a user of occurrence of an error when the data in excess of the first maximum printable number of lines is recognized by the first data-recognizing means, and second error notification means for notifying the user of occurrence of an error when the data in excess of the second maximum printable number of lines is recognized by the second data-recognizing means, and wherein the first error notification means and the second error notification means notify the user of occurrence of the errors in respective manners different from each other.

According to this preferred embodiment, depending on whether the inputted data has exceeded the first maximum printable number of lines or the second maximum printable number of lines, it is possible to output a different error message. This makes it possible to cause the user to know which maximum printable number of lines the inputted data has exceeded.

Preferably, one of the first error notification means and the second error notification means notifies the user of occurrence of a corresponding one of the errors by making an electronic sound.

According to this preferred embodiment, one of the first error notification means and the second error notification means notifies the user of occurrence of an error by making an electric sound. This makes it possible to clearly notify the user of an error.

Preferably, the first error notification means and the second error notification means notify the user of occurrence of the errors by making respective electronic sounds different from each other.

According to this preferred embodiment, the first error notification means and the second error notification means notifies the user of occurrence of the errors by making respective electronic sounds different from each other. This make it possible to cause the user to know which maximum printable number of lines the inputted data has exceeded.

Preferably, one of the first error notification means and the second error notification means notifies the user of occurrence of a corresponding of the errors by causing the display means to display characters to the effect that the inputted data has exceeded a corresponding one of the first maximum printable number and the second maximum printable number of lines.

According to this preferred embodiment, one of the first error notification means and the second error notification means notifies the user of occurrence of an error by displaying characters to the effect that the inputted data has exceeded a corresponding one of the first maximum printable number and the second maximum printable number of lines. This enables the user to determine the kind of an error at a glance without need to refer to an instruction manual or the like.

Preferably, the first error notification means and the second error notification means each notify the user of occurrence of a corresponding one of the errors by causing the display means to display characters to the effect that the inputted data has exceeded a corresponding one of the first maximum printable number of lines and the second maximum printable number of lines.

According to this preferred embodiment, the first error notification means and the second error notification means notify the user of occurrence of a corresponding one of the errors by displaying characters to the effect that the inputted data has exceeded a corresponding one of the first and second maximum printable numbers of lines. This make it possible to cause the user to recognize at a glance which maximum printable number of lines the inputted data has exceeded.

Preferably, one of the first error notification means and the second error notification means notifies the user of occurrence of a corresponding one of the errors by causing the display means to display the data in excess of a corresponding one of the first maximum printable number of lines and the second maximum printable number of lines in a different display mode from a different mode for displaying the data within the corresponding one of the first maximum printable number of lines and the second maximum printable number of lines.

According to this preferred embodiment, one of the first error notification means and the second error notification means notifies the user of occurrence of an error by causing the display means to display data in excess of a corresponding one of the first and second maximum printable numbers of lines in a visually different display mode from a display mode for displaying the data within a corresponding one of the first and second maximum printable numbers of lines. Therefore, there is no need to provide an area for displaying an error, and even if the display screen is capable of displaying only one line, it is possible to display an error while displaying inputted data.

Preferably, the first error notification means and the second error notification means notify the user of occurrence of the errors by causing the display means to display the data in excess of the first maximum printable number of lines and the data in excess of the second maximum printable number of lines in respective display modes which are different from a display mode for displaying the data within the first maximum printable number of lines, and at the same time different from each other.

According to this preferred embodiment, the first error notification means and the second error notification means notify the user of occurrence of errors by displaying data in excess of the respective maximum printable numbers of lines in visually different display modes which are different from a display mode for displaying the data within the first maximum printable number of lines, and at the same time visually different from each other. This make it possible to cause the user to recognize which maximum printable number of lines the inputted data has exceeded.

Preferably, the tape printing apparatus further comprises input-inhibiting means for inhibiting data from being inputted when the data inputted by the input means has exceeded a number of lines determined by adding the predetermined number of lines to the second maximum printable number of lines.

According to this preferred embodiment, when the data inputted by the input means has exceeded the number of lines determined by adding the predetermined number of lines to the second maximum printable number of lines, the inputting of the data is inhibited. This makes it possible to prevent undisplayable and useless data from being inputted.

Preferably, the tape printing apparatus further comprises error notification means for notifying the user of occurrence of an error when the inputting of data is inhibited by the input-inhibiting means.

According to this preferred embodiment, when inputting of data is inhibited, the user is notified of occurrence of an error, whereby the user can recognize that he is inputting undisplayable data.

Preferably, the error notification means notifies the user of occurrence of the error by temporarily stopping the display means from performing display.

According to this preferred embodiment, the display means is stopped from performing display to thereby notify the user of occurrence of an error. This enables the user to clearly recognize that he is inputting undisplayable data.

The above and other objects, features, and advantages of the invention will become more apparent from the following detailed description taken in conjunction with the accompanying drawings.

BRIEF DESCRIPTION OF THE DRAWINGS

FIG. 14A is an explanatory view which is useful in explaining the relationship between the widths of tapes and maximum printable numbers of lines;

FIG. 14B is an explanatory view which is useful in explaining the relationship between the width of a print head and the maximum printable number of lines;

DETAILED DESCRIPTION OF PREFERRED EMBODIMENTS

The invention will now be described in detail with reference to the drawings illustrating a tape printing apparatus and a data input processing method therefor, according to an embodiment of the invention. The tape printing apparatus according to the invention determines a maximum printable number of lines based on the width of a tape or the width of a print head, and carries out data input processing for inputting data within the range of the number of lines (maximum displayable number of lines) determined by adding a predetermined number of lines (predetermined number of lines) to the maximum printable number of lines. In other words, the tape printing apparatus is capable of using an area for displaying the above predetermined number of lines as an edit area for trial input or the like, thereby enhancing the operability of the apparatus in inputting data.

Figure 1:
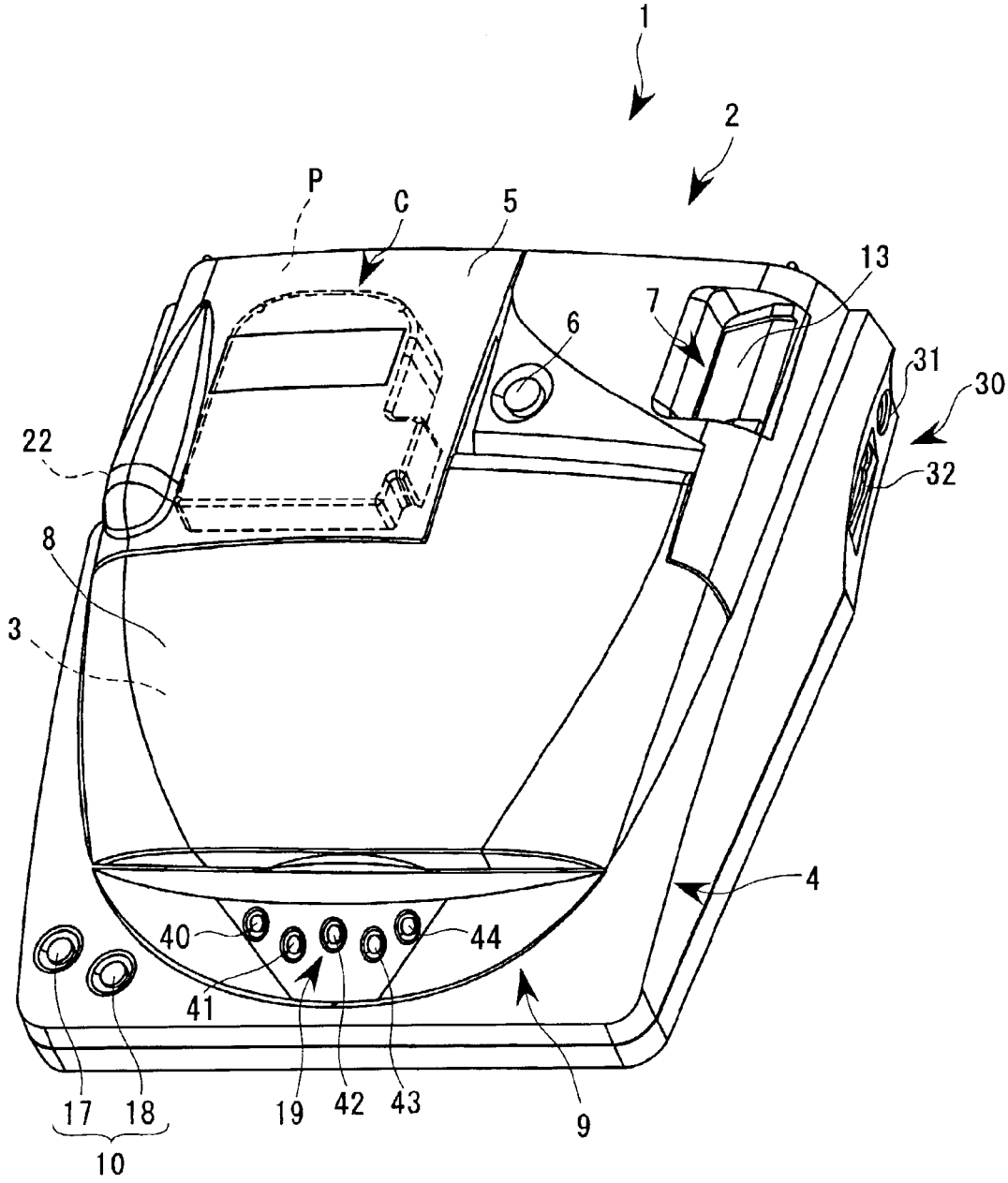
FIG. 1 is a perspective view of the appearance of a tape printing apparatus according to an embodiment of the present invention.
Figure 2:
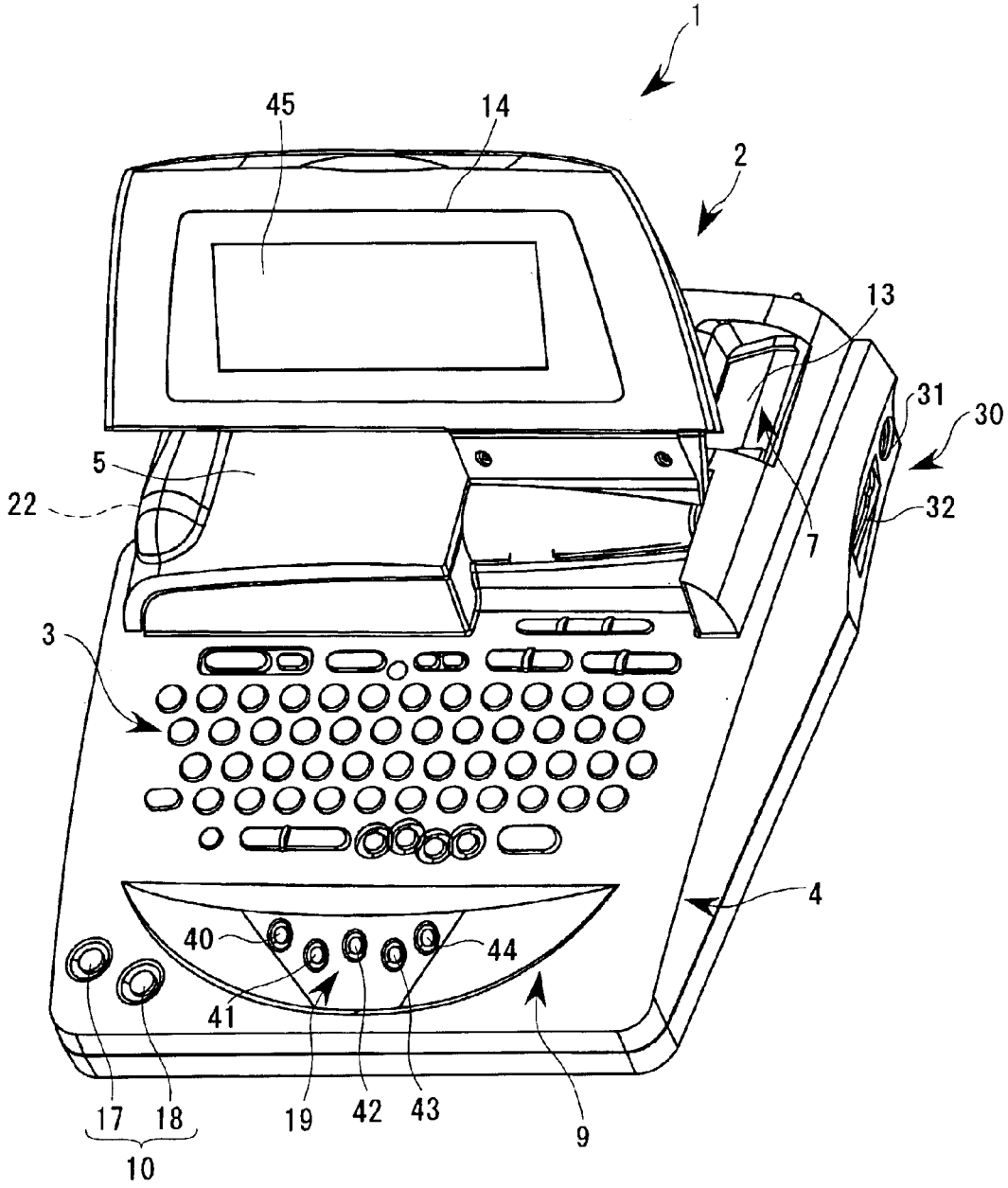
FIG. 2 is a perspective view of the appearance of the FIG. 1 tape printing apparatus with a cover assembly thereof open.

The construction of the tape printing apparatus 1 will be described. FIG. 1 shows the appearance of the whole tape printing apparatus 1 according to the present embodiment. FIG. 2 shows the tape printing apparatus 1 with a cover assembly 8 thereof open, while FIG. 3 shows the apparatus 1 with the cover assembly 8 thereof closed, and with a lid 5 thereof open and a tape cartridge C mounted therein.

Figure 3:
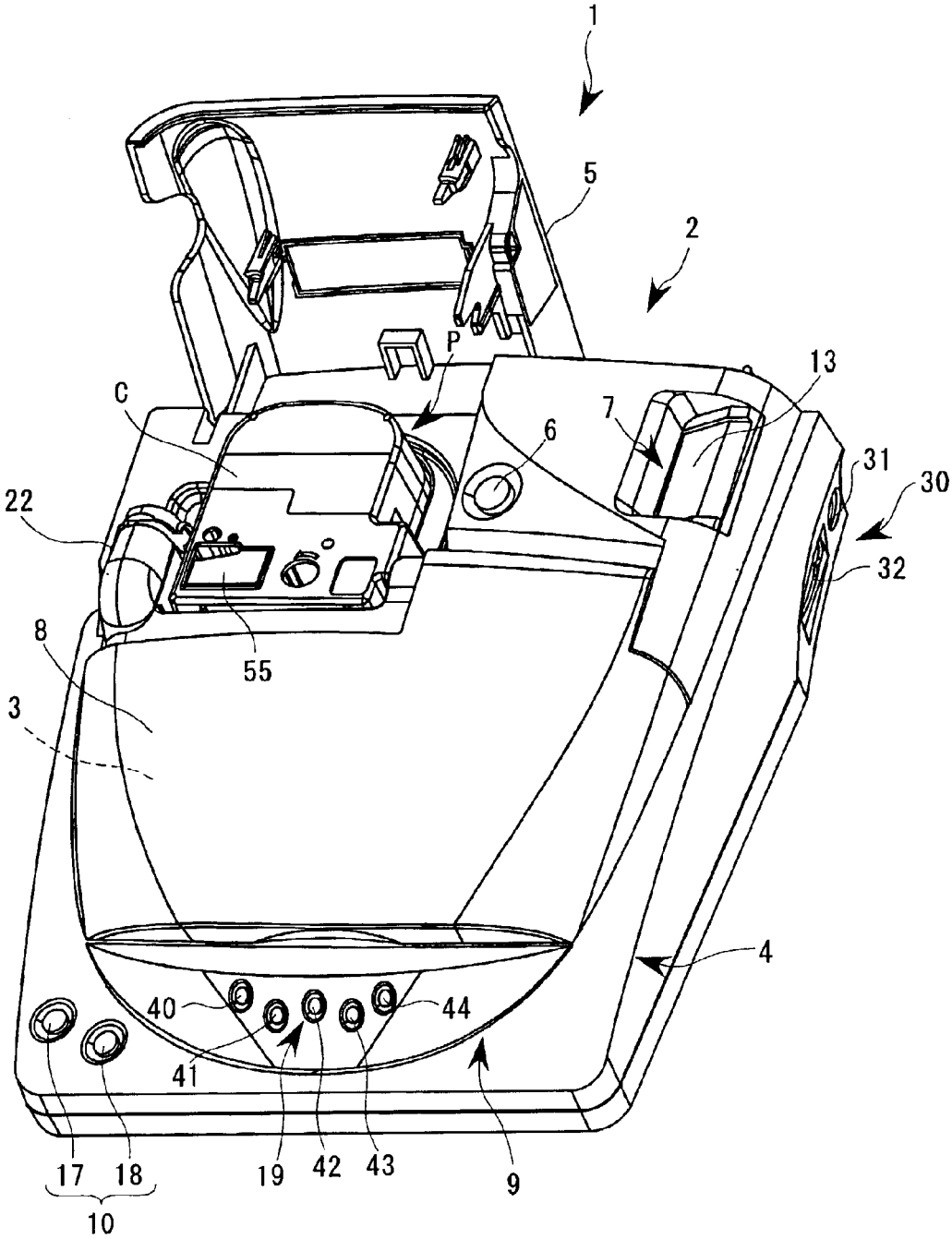
FIG. 3 is a perspective view of the appearance of the FIG. 1 tape printing apparatus with the cover assembly thereof closed, and with a lid thereof open and a tape cartridge mounted therein.

As shown in FIGS. 1 to 3, the tape printing apparatus 1 is comprised of a main unit 2 having an apparatus casing 4 forming an outer shell thereof, and the tape cartridge C removably mounted in the main unit 2. The main unit 2 is comprised of the lid 5 formed with a window, which is attached to the top of the rear left-hand portion of the apparatus casing 4, a lid-opening button 6 arranged at a location adjacent to the right-hand side of the lid 5, for use in opening and closing the lid 5, a trimming device 7 arranged in the top of the apparatus casing 4 at a location rightward of the lid-opening button 6, the cover assembly 8 including a display 14 and mounted to the central portion of the apparatus casing 4 in a manner such that the cover assembly 8 can be opened and closed, and a crescent-shaped block 9 including an exposed lamp group 19 and raised upward from the apparatus casing 4 at a location forward of the cover assembly 8. Further, an exposed key group 10 comprised of two keys is arranged in the top of the apparatus casing 4 at a location leftward of the crescent-shaped block 9, and a keyboard 3 which is covered by the cover assembly 8 when the cover assembly 8 is closed and exposed when the cover assembly 8 is opened is arranged in the same plane where the exposed key group 10 is arranged. Under the lid 5, there is formed a compartment P in which the tape cartridge C is removably mounted.

As shown in FIGS. 1 to 3, according to the tape printing apparatus 1, a user opens the lid 5 by operating the lid-opening button 6, mounts the tape cartridge C in the compartment P, opens the cover assembly 8 to thereby make the keyboard 3 accessible for key entry, and then operates the keyboard 3 while viewing the display 14 (display screen 45). When the user enters printing information, such as desired characters (letters, numerals, symbols, simple figures, etc.) and instructs the apparatus 1 to perform a printing operation via the keyboard 3, a tape T is unwound from the tape cartridge C, and desired printing is conducted on the tape T by a print head 122. The printed portion of the tape T is sent out via a tape exit 22 as the printing proceeds. When the desired printing is completed, the tape T is further advanced to a position corresponding to termination of a tape length including the length of margins, and then the feeding of the tape is stopped, followed by cutting off the portion of the tape T sent out with a tape cutter 132 arranged at the tape exit 22.

The corners of the cut-off strip of the printing tape T thus formed can be trimmed by the trimming device 7. More specifically, the user inserts the tape T into a slit of the trimming device 7 along a tape-inserting guide 13 sloped inwardly downward from the top of the apparatus casing 4, and a trimming mechanism of the device 7 is automatically started in response to the insertion of the tape T to trim the corners of the cut-off strip of the printing tape T into ones with a radius.

The tape T is comprised of an image-receiving layer Ta, not shown, serving as a printing surface, an adhesive layer Tb, not shown, coated on the underside surface of the image-receiving layer Ta, and a peel layer Tc, not shown, peelably covering the underside surface of the adhesive layer Tb. The tape T and an ink ribbon R are fed or run such that they pass by a through hole 55, in a state lying one upon the other. Then, the tape T alone is delivered out of the tape cartridge C, whereas the ink ribbon R is taken up into a roll within the tape cartridge C. From the tape T (printed portion thereof cut off as described above) delivered out of the apparatus, the peel layer Tc is peeled off, and then the tape T is affixed to an object article. It should be noted that in the tape printing apparatus 1, a single-layer tape T (i.e. without the peel layer Tc) can also be used.

Now, the tape printing apparatus 1 is capable of printing data inputted and edited by a personal computer PC on a tape T by connecting the main unit 2 to the personal computer PC with the cable. The tape printing apparatus 1 and the personal computer PC are placed in a communicative connection wait state by connecting between the main unit 2 and the PC with the cable, and the communicative connection wait state can be switched to a communicative connection-enabled state by turning on a communication input key 18. Further, since a connection terminal block 30 comprised of an AC adapter connector port 31 into which a plug of a cord of an AC adapter, not shown, is inserted and a data input port into which a connector, not shown, of the cable is inserted is arranged on the side opposite to the tape exit 22 in the apparatus casing 4, the cable and the cord of the AC adapter, which are connected to the main unit 2, do not obstruct or interfere with picking up of a dispensed portion of the tape T. Further, the tape printing apparatus 1 is capable of printing print data inputted by the PC on the tape T even when the apparatus is in an upright position with the rear surface thereof directed downward and serving as the bottom of the apparatus.

When the tape printing apparatus 1 is communicatively connected to the PC as described above, it is not required to use the keyboard 3, and hence the keyboard 3 may be covered by the cover assembly 8 as shown in FIG. 1.

The exposed lamp group 19 is comprised of a plurality of indicator lamps arranged in the central portion of the crescent-shaped block 9. More specifically, the indicator lamps include a printing indicator lamp 40, a power supply indicator lamp 41, an automatic cutting indicator lamp 42, a communication indicator lamp 43, and a trimming indicator lamp 44 arranged in the mentioned order from the left as viewed in FIGS. 1 to 3, and each indicator lamp is lighted (turned on) and extinguished (turned off) according to corresponding operating states of the apparatus 1. The printing indicator lamp 40 is on when the tape T is being subjected to printing and a printed portion of the tape T is being cut off, while the automatic cutting indicator lamp 42 is on when the function of cutting the tape T not manually but automatically is set. The communication indicator lamp 43 is on when the communication input key 18, referred to hereinafter, has been turned on. The trimming indicator lamp 44 is on during cutting and shaping of corners of a printed strip of the tape T by the trimming device 7.

The exposed key group 10 is comprised of a power input key 17 and the communication input key 18 arranged immediately adjacent to each other on the left-hand side and the right-hand side, respectively. The power input key 17 turns on and off the power of the main unit 2, while the communication input key 18 enables and disables communicative connection between the apparatus 1 and the PC.

Figure 4:
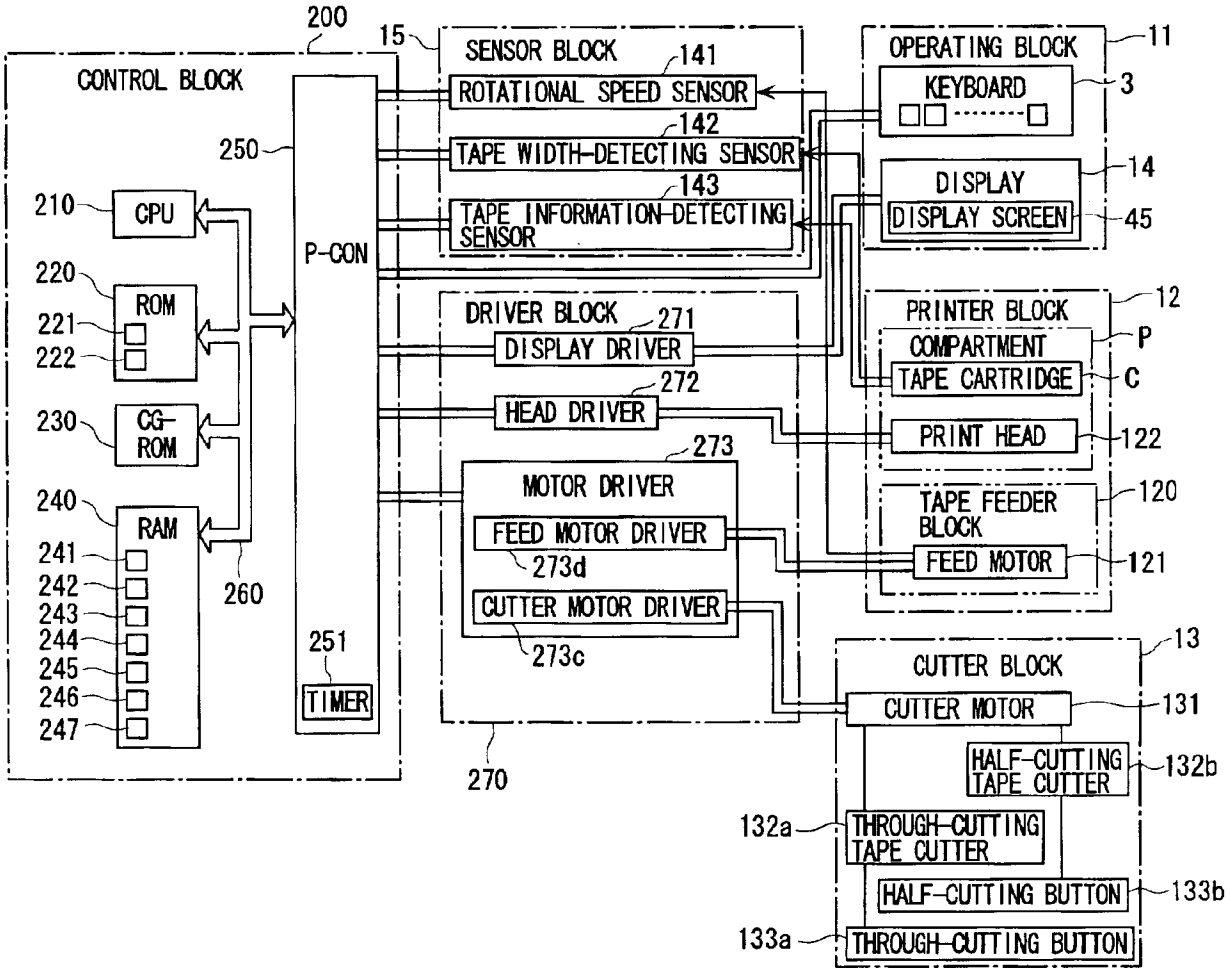
FIG. 4 is a block diagram schematically showing a control system of the FIG. 1 tape printing apparatus.

Next, the basic arrangement of the control system of the printing apparatus 1 will be described. As shown in FIG. 4, the tape printing apparatus 1 is basically comprised of an operating block 11 having the keyboard 3 and the display 14 and interfacing with the user, a printer block 12 having a print head (thermal head) 122 and a tape feeder block 120 and performing printing on the tape T unwound from the tape cartridge C in the compartment P, a cutter block 13 for cutting the printed portion of the tape T, a sensor block 15 having various sensors for carrying out various detecting operations, a driver block 270 having drivers for driving circuits of various devices, and a control block 200 for controlling operations of components of the tape printing apparatus 1. To implement this construction of the present embodiment, the apparatus casing 4 accommodates a circuit board, not shown, in addition to the printer block 12, the cutter block 13, the sensor block 15 and so forth. On the circuit board, there are mounted a power supply unit, not shown, the circuits of the driving block 270 and the control block 200, etc. The circuit board is connected to the AC adapter connector port 31, and batteries, such as nicad batteries, which can be removably mounted within the casing 2 from outside.

The operating block 11 is comprised of the keyboard 3 and the display 14. The display 14 has the display screen 45 which is capable of displaying display image data of 96 by 64 dots on a rectangular display area of approximately 6 cm in the horizontal direction (X direction) by 4 cm in the vertical direction (Y direction). The display 4 is made use of by the user when he inputs data via the keyboard 3 to form or edit print image data, such as character string image data, views the resulting data, and inputs various commands including ones for selecting menu options via the keyboard 3.

On the keyboard 3, there are arranged a character key group including an alphabet key group, a number key group, and a nonstandard character key group for calling nonstandard characters for selection, as well as a function key group for designating various operation modes. In a type of the apparatus which is capable of inputting the Japanese language, the character key group also includes the function of a kana key group for inputting Japanese hiragana letters and Japanese katakana letters. The function key group includes a print key for instructing the apparatus 1 to execute printing, a new line start key for use in instructing the starting of a new line, a selection key for use in selecting a desired function from displayed menu options (or for use in selecting a desired kanji letter from candidate kanji letters presented in kana-kanji conversion which is executed by the type of apparatus capable of inputting the Japanese language), a delete key for deleting characters or canceling operations carried out for various functions, a restoration key for pasting data stored in a restoration buffer, referred to hereinafter, and four cursor keys (up arrow key, down arrow key, left arrow key, and right arrow key) for moving a cursor K (see D11 in FIG. 6) in respective upward, downward, leftward, and rightward directions, for designating a position at which a character is to be entered next or a position at which operation is to be carried out. Of course, similarly to keyboards of the general type, the above-mentioned key entries may be made by the respective keys exclusively provided therefor or by a smaller number of keys operated in combination with a shift key and/or the like. As shown in FIG. 4, by using the keyboard 3, various commands and data are inputted to the control block 200.

The tape feeder block 120 includes a feed motor 121 for feeding the tape T. The feed motor 121 has an end thereof rigidly fixed to a disc, not shown, formed with detection openings, and a rotational speed sensor 141 including a photo sensor or the like is arranged such that the sensor 141 faces the rotational path of the detection openings, for sending information of the rotational speed of the feed motor 121 detected thereby to the control block 200.

The printer block 12 has the compartment P formed under the lid 5, for receiving the tape cartridge C therein. The tape cartridge C can be mounted in or removed from the compartment P when the lid 5 is open. The tape cartridge C has a cartridge casing 51 holding the tape T and the ink ribbon R each having a predetermined width (approximately 6 to 36 mm). Further, the tape cartridge C is formed with the through hole 55 for receiving therein a head unit arranged in the compartment P.

Figure 15A:
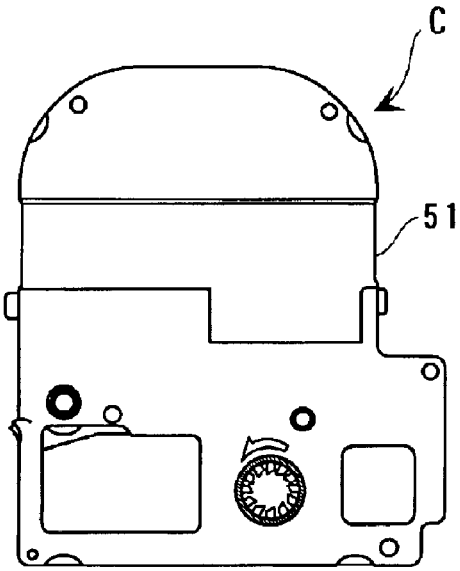
FIG. 15A is a top view showing the top of a tape cartridge.
Figure 15B:
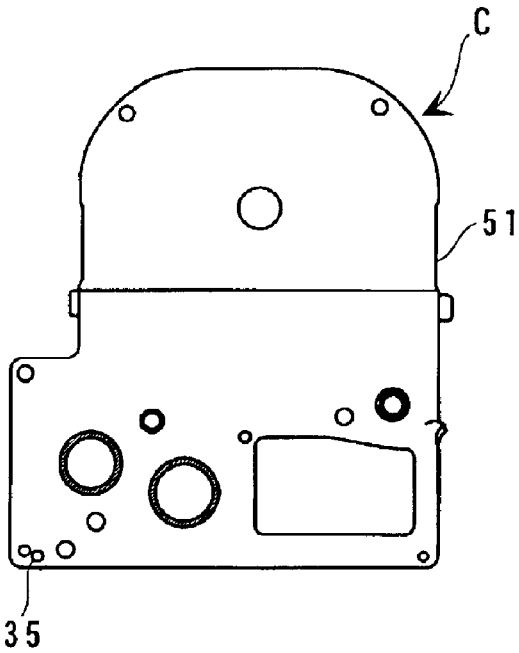
FIG. 15B is a bottom view showing the bottom of the tape cartridge.
Figure 15C:
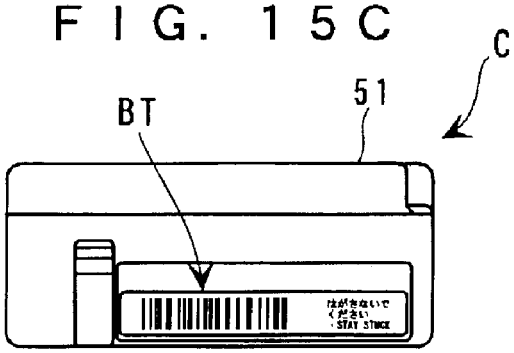
FIG. 15C is a rear view showing the rear of the tape cartridge.

Further, as shown in FIGS. 15A to 15C, the tape cartridge C also has a plurality of small holes 35 formed in the bottom thereof, for discrimination of the type of the tape T contained therein from the other types of the tape T having different widths, which are contained in other tape cartridges C. The compartment P has a tape width-detecting sensor 142, implemented e.g. by micro-switches, for detecting the above holes 35 to thereby determine the width of the tape T set for use. The maximum printable number of lines (first maximum printable number of lines) is determined based on the width of the tape T detected by the tape width-detecting sensor 142 (see FIG. 14A). Further, as shown in FIGS. 15A to 15C, in the present embodiment, a barcode tape BT bearing, as a barcode, information of the materials, thicknesses, colors, and the like of members forming a tape T accommodated in the cartridge casing 51 is affixed to the bottom surface of the cartridge casing 51. The information encoded as the barcode can be detected by a tape information-detecting sensor 143 implemented by a photo sensor or the like.

The cutter block 13 is comprised of the through-cutting tape cutter 132*a* for cutting through the tape T, a half-cutting tape cutter 132*b* for cutting only the image-receiving layer Ta and adhesive layer Tb of the tape T, cutting buttons 133*a,* 133*b* to be manually operated for causing the respective tape cutters 132*a*, 132*b* to cut the tape T e.g. in the case of desired length printing, and a cutter motor 131 for automatically actuating the tape cutters 132*a,* 132*b* to cut the tape T e.g. in the case of fixed length printing.

The tape printing apparatus 1 can be switched between a manual cutting mode and an automatic cutting mode by a cutting mode-setting operation. In the manual cutting mode, after completion of a printing operation, the user pushes the cutting buttons 133*a,* 133*b* arranged on the apparatus casing 4, whereby the tape cutters 132*a,* 132*b* are actuated to cut the tape T to a desired length. On the other hand, in the automatic cutting mode, after completion of a printing operation, the tape T is sent for additional feed by the length of a rear margin, and then stopped, whereupon the cutter motor 131 is driven for cutting the tape T. It should be noted that in the automatic cutting mode, when the apparatus 1 has been set to perform half-cutting, the half-cutting tape cutter 132*b* is actuated, whereas when no particular cutting method is designated, the through-cutting tape cutter 132*a* is actuated.

When the automatic cutting mode is set by the mode-setting operation, the type of the tape T is detected by the tape information-detecting sensor 143, and based on a result of the detection, whether or not the cutter motor 131 should be driven is set. More specifically, whether or not both through-cutting and half-cutting should be carried out is set based on a result of the detection.

The sensor block 15 includes the rotational speed sensor 141, the tape width-detecting sensor 142, and the tape information-detecting sensor 143, as described above. It should be noted that the above sensors can be omitted to suit the actual requirements of the tape printing apparatus.

The driving block 270 is comprised of a display driver 271, a head driver 272, and a motor driver 273. The display driver 271 drives the display 14 of the operating block 11 in response to control signals delivered from the control block 200, i.e. in accordance with commands therefrom. Similarly, the head driver 272 drives the print head 122 of the printer block 12, in accordance with commands from the control block 200. The motor driver 273 includes a feed motor driver 273*d* for driving the feed motor 121 of the printer block 12, and a cutter motor driver 273*c* for driving the cutter motor 131 of the cutter block 13, which similarly to the above drivers, drive the respective motors in accordance with commands from the control block 200.

The control block 200 includes a CPU 210, a ROM 220, a character generator ROM (CG-ROM) 230, a RAM 240, and a peripheral control circuit (P-CON) 250, all of which are connected to each other by an internal bus 260. The ROM 220 has a control program area 221 for storing control programs executed by the CPU 210 as well as a control data area 222 for storing control data including a character list table, a cuttable tape material list table, a color conversion table, and a character modification table. The CG-ROM 230 stores bitmap data of symbols, figures and the like, which is provided for the tape printing apparatus 1. When code data specifying a character or the like is inputted thereto, it outputs the corresponding bitmap data.

The RAM (storage device) 240 is supplied with power by a backup circuit, not shown, such that stored data items can be preserved even when the power is turned off by operating the power key 17. The RAM 240 includes areas of a register group 241, a character data area 242 for storing character data of letters or the like entered by the user via the keyboard 3, a display image data area 243 for storing image data displayed on the display screen 45, a print image data area 244 for storing print image data, a registered image data area 245 for storing registered image data, as well as a print history data area 246 and conversion buffer areas 247 including color conversion buffers. The RAM 240 is used as work areas for carrying out various control processes. It should be noted that the conversion buffer areas 247 also include the restoration buffer used in a "cut & paste" function, referred to hereinafter.

The P-CON 250 incorporates logic circuits for complementing the functions of the CPU 210 and for dealing with interface signals for interfacing between the CPU 210 and peripheral circuits. The logic circuits are implemented by gate arrays, a custom LSI and the like. For example, a timer 251 is incorporated in the P-CON 250 for a function thereof for measuring elapsed time. The P-CON 250 is connected to the sensors of the sensor block 15 and the keyboard 3, for receiving the above-mentioned signals generated by the sensor block 15 as well as commands and data input via the keyboard 3, and inputting these to the internal bus 260 directly or after processing them. Further, the P-CON 250 cooperates with the CPU 210 to output data and control signals inputted to the internal bus 260 by the CPU 210 or the like, to the driving block 270 directly or after processing them.

The CPU 210 receives the signals from the sensor block 15, the commands and data inputted via the keyboard 3, etc. via the P-CON 250, according to the control programs read from the ROM 220, processes bitmap data from the CG-ROM 230 and various data stored in the RAM 240, and delivers control signals to the driving block 270 via the P-CON 250 to thereby carry out position control during printing operations, display control of the display screen 45, etc. Further, the CPU 210 causes the print head 122 to carry out printing on the tape T under predetermined printing conditions. In short, the CPU 210 controls the overall operation of the tape printing apparatus 1.

Next, the data input processing method for the tape printing apparatus 1 will be described. As described above, the tape printing apparatus 1 according to the present invention determines the maximum printable number of lines based on the width of the tape, or the width of the print head, and carries out the data input processing for inputting data within the number of lines (maximum displayable number of lines) obtained by adding a predetermined number of lines to the maximum printable number of lines. The tape printing apparatus is capable of using an area for displaying the above predetermined number of lines as an edit area for trial input or the like, thereby enhancing the operability of the apparatus in inputting data. It should be noted that in the following, description is given assuming that the above predetermined number of lines is "one line".

Figure 5:
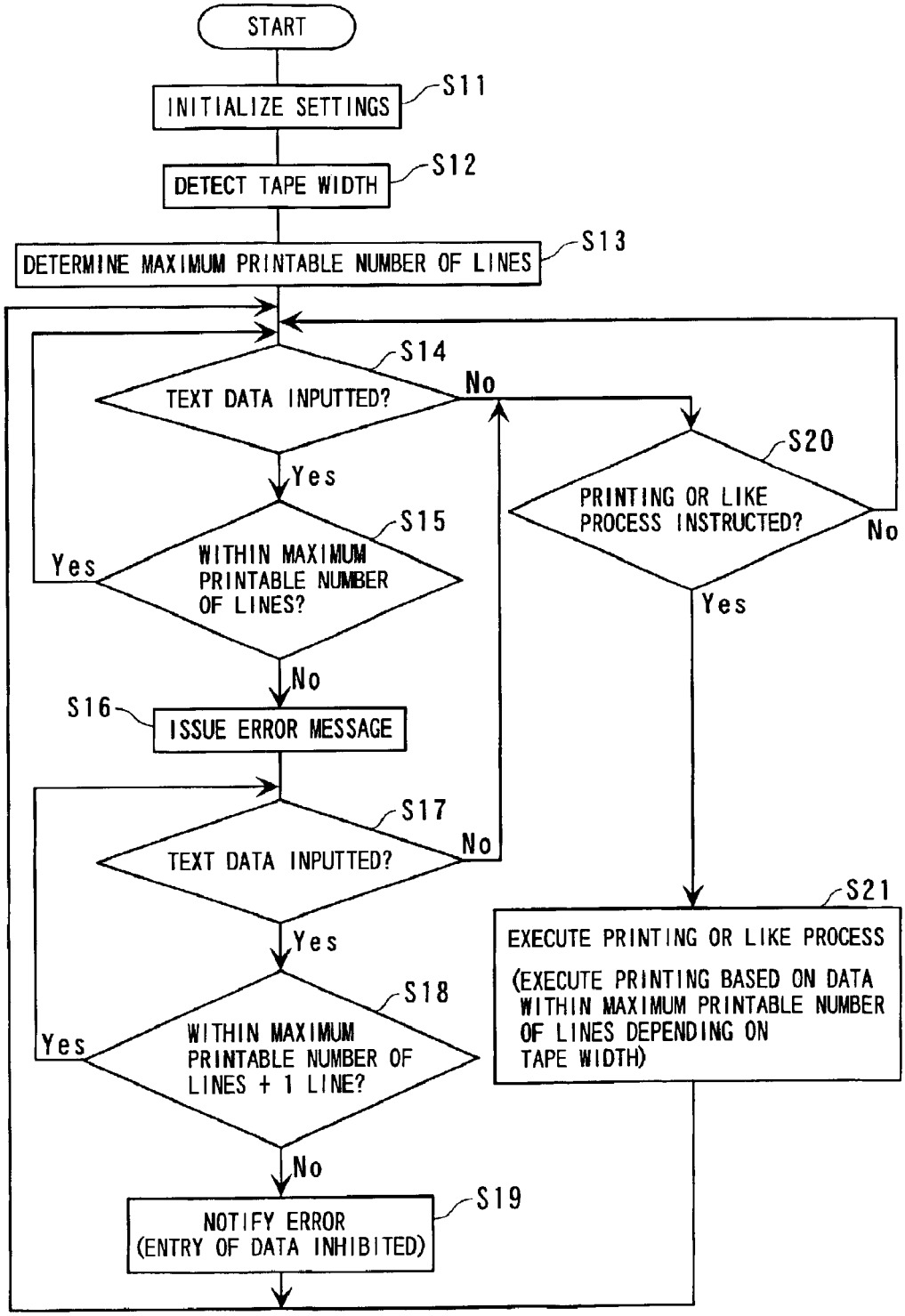
FIG. 5 is a flowchart useful in explaining an overall flow of first and second examples of a data input processing method according to the embodiment.
Figure 6:
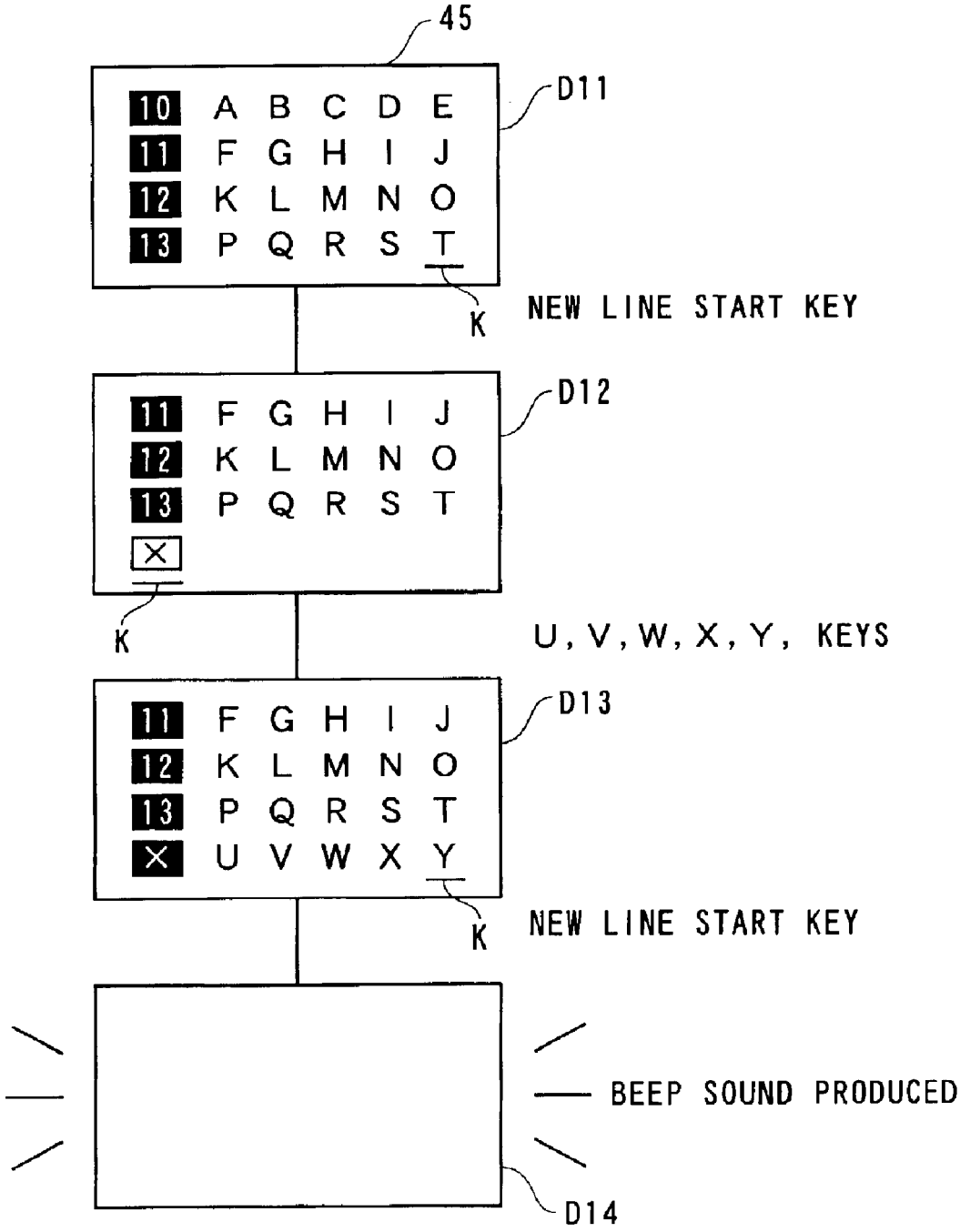
FIG. 6 is a diagram useful in explaining the first and second examples of the data input processing method according to the embodiment, using images displayed on a display screen.

First, a case in which the maximum printable number of lines is determined based on the width of the tape T is described as a first example of the present embodiment with reference to FIGS. 5 and 6. When the power is turned on by the user, the initialization of the system is carried out in a step S11, and the width of the tape T is detected by the tape width-detecting sensor 142 in a step S12. Then, the maximum printable number of lines is determined based on the detected tape width in a step S13. The relationship between the tape width and the maximum printable number of lines is shown in FIG. 14A. Now, let it be assumed that a tape cartridge C accommodating a tape having a tape width of 36 mm is mounted in the apparatus 1. Since the maximum printable number of lines for this type of tape is 13 (see FIG. 14A), the maximum printable number of lines determined here is 13.

Next, when text data is inputted by the user by using the keyboard 3 (Yes to S14, see D11 in FIG. 6), it is determined in a step S15 whether or not the inputted text data is within the maximum printable number of lines whenever a key entry is made. In this case, according to the present embodiment, it is assumed that the number of characters (amount of data) printable in one line is not limited, and that whether or not the inputted text data is within the maximum printable number of lines is determined by counting the number of depressions of the new line start key in one text (data within the maximum printable number of lines is recognized). Therefore, when the new line start key is depressed thirteen or more times [No to S15; when the new line start key is depressed in a state of D11 in FIG. 6 (i.e. with the cursor K being attached to text data on a thirteenth line), in other words, when data having the number of lines larger in number than the maximum printable number of lines is recognized], an error notification is carried out in a step S16.

In this case, the error notification is carried out by a line head-indicating mark with a letter "X" (line-head inhibit mark) (see D12 in FIG. 6). Further, the line-head inhibit mark "X" is initially in black against a white background, and reversely displayed in white against a black background when text data has been inputted to a line having the mark "X". It should be noted that each of respective line head-indicating marks on other lines (lines within the maximum printable number of lines) is also initially in black against a white background, and is reversely displayed in white against a black background when text data has been inputted to a corresponding line.

Then, when text data is further inputted (Yes to S17), it is determined in a step S18 whether or not the text data is within a maximum printable number of lines+one line. The maximum printable number of lines+one (line) is the maximum number of lines displayable on the display screen 45 (maximum displayable number of lines). Therefore, now, when the new line start key is depressed fourteen or more times (No to S18, when the new line start key is depressed fourteen or more times in a state of D13 in FIG. 6), an error notification is carried out and at the same time the inputting of data is inhibited in a step S19. In this case, the error notification is carried out by temporarily making the text data undisplayable on the display screen 45 and at the same time issuing a beep sound (electronic sound) (see D14 in FIG. 6). It should be noted that the error notification may be carried out either by temporarily making the text data undisplayable on the display screen 45 or by producing a beep sound. As described above, by temporarily making the text data undisplayable on the display screen 45 and/or by producing a beep sound, the error can be clearly notified to the user. Further, if a key other than the keys used for inputting text data is depressed in the step S14 or S17 (if a printing or like process is instructed in a step S20), the process is carried out in accordance with the instruction in a step S21. The printing process in this embodiment is carried out based on data within the maximum printable number of lines (13 lines) determined based on the tape width. In other words, data "UVWXY" on a fourteenth line used as an edit area is not reflected in printing.

Next, a case in which the maximum printable number of lines is determined based on the width of the print head will be described as a second example of the present embodiment. The width of the print head is determined based on a maximum tape width of tapes mountable in the apparatus 1. In the case of the present example, although the width of the print head is 27 mm, the maximum tape width of tapes mountable in the apparatus 1 is 36 mm, so that the maximum printable number of lines is set to 13, as shown in FIG. 14B, in a manner adapted to the maximum tape width. More specifically, in this case, the maximum displayable number of lines is fourteen [14=13 (the maximum printable number of lines)+1 (predetermined number of lines (edit area)]. It should be noted that in determining the maximum printable number of lines based on the width of the print head, there is carried out substantially the same process as the process described above with reference to FIGS. 5 and 6 which is carried out in determining the maximum printable number of lines based on the width of the tape T. More specifically, the former case is distinguished from the latter case only in that the maximum printable number of lines is not determined based on a result of detection of the tape width (S12), but it is always determined to be thirteen (lines) irrespective of the width of the tape T set for use (the maximum displayable number of lines is determined to be fourteen), so that detailed description thereof is omitted.

However, the printing process is carried out according to the result of detection of the tape width (S12) based on data printable on the width of a tape in actual use. For example, when the tape having the tape width of 36 mm is employed, data on the fourteenth line is not reflected in printing since only maximum thirteen lines can be printed on the tape. Further, when a tape having a tape width of 6 mm is employed, data on a third line to the fourteenth line is not reflected in printing since only maximum two lines can be printed on the tape. That is, although the maximum displayable number of lines is always determined to be fourteen, data to be actually printed is determined based on the width of a tape.

Figure 7:
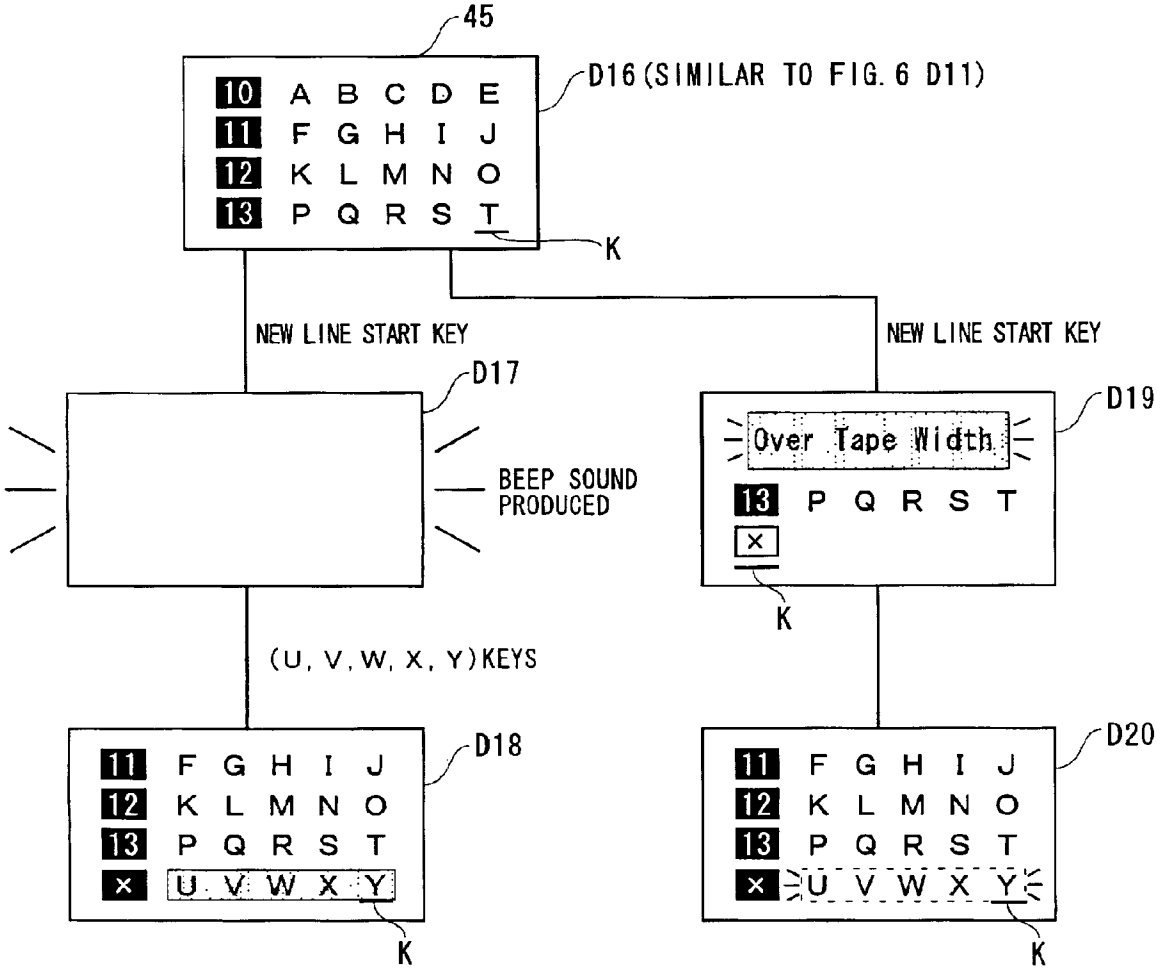
FIG. 7 is a diagram similar to FIG. 6, which is useful in explaining a variation of the first and second examples of the embodiment, using images displayed on the display screen.

It should be noted that methods of error notification are not limited to the above examples, but other methods may be employed. For example, as shown in FIG. 7, when the new line start key is depressed in a state in which the cursor K is attached to the text data on the thirteenth line of the maximum printable number of lines (see D16), text data may be temporarily made undisplayable on the display screen 45, and the beep sound may be produced (see D17), whereby the user may be caused to be aware that he is about to input text data in excess of the maximum printable number of lines. Further, when text data has been inputted in the edit area (on the fourteenth line), characters may be displayed in half-tone dot meshing (see D18) such that the user is caused to be conscious of his inputting of text data in the edit area.

Further, when the maximum displayable number of lines is determined based on the tape width (in the case of the first example of the present embodiment), as shown in FIG. 7, when the new line start key is depressed in a state in which the cursor K is attached to the text data on the thirteenth line of the maximum printable number of lines (see D16), a phrase "Over Tape Width" is displayed in half-tone dot meshing and flashing text (see D19), whereby the user is caused to be aware that he is about to input text data in excess of the tape width. Further, when text data has been inputted in the edit area (on the fourteenth line), inputted characters may be displayed in flashing text (see D20) such that the user is caused to be conscious of his inputting of text data in the edit area.

Figure 8:
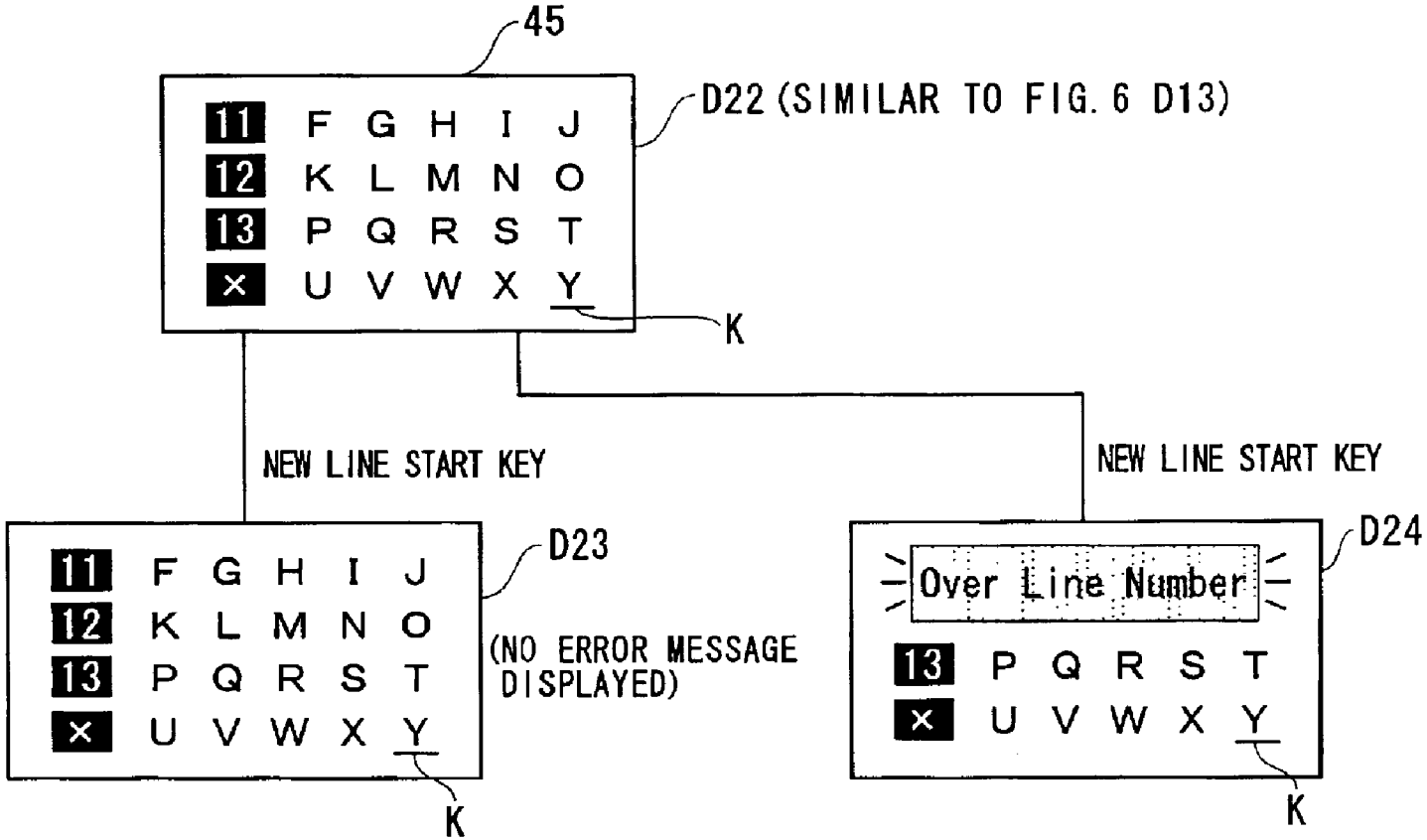
FIG. 8 is a diagram similar to FIG. 6, which is useful in explaining another variation of the first and second examples of the embodiment, using images displayed on the display screen.

Further, as shown in FIG. 8, even if the new line start key is depressed in a state in which the cursor K is attached to text data on a fourteenth line (last line of the edit area) of the maximum displayable number of lines (see D22), inputting of data may be merely inhibited (see D23) without changing the state of the text data being displayed on the display screen (without displaying any error message). According to this configuration, it is possible to simplify control of error processing since there is no need to carry out a special process for notifying the user of the error.

Further, as shown in FIG. 8, when the new line start key is depressed in the state in which the cursor K is attached to the text data on the fourteenth line of the maximum displayable number of lines (see D22), a phrase "Over Line Number" may be displayed in half-tone dot meshing and flashing text (see D24), to thereby cause the user to be aware that the inputted text data has exceeded the displayable number of lines.

As described hereinabove, according to the first and second examples of the present embodiment, of the inputted data, not only data within the maximum printable number of lines unconditionally determined based on the width of a tape or the width of a print head but also data of a predetermined number of lines in excess of the maximum printable number of lines can be displayed. In other words, the area for displaying the above predetermined number of lines can be used as an edit area for trial input of data or the like. This makes it possible to enhance the operability of the apparatus in inputting data.

Figure 9:
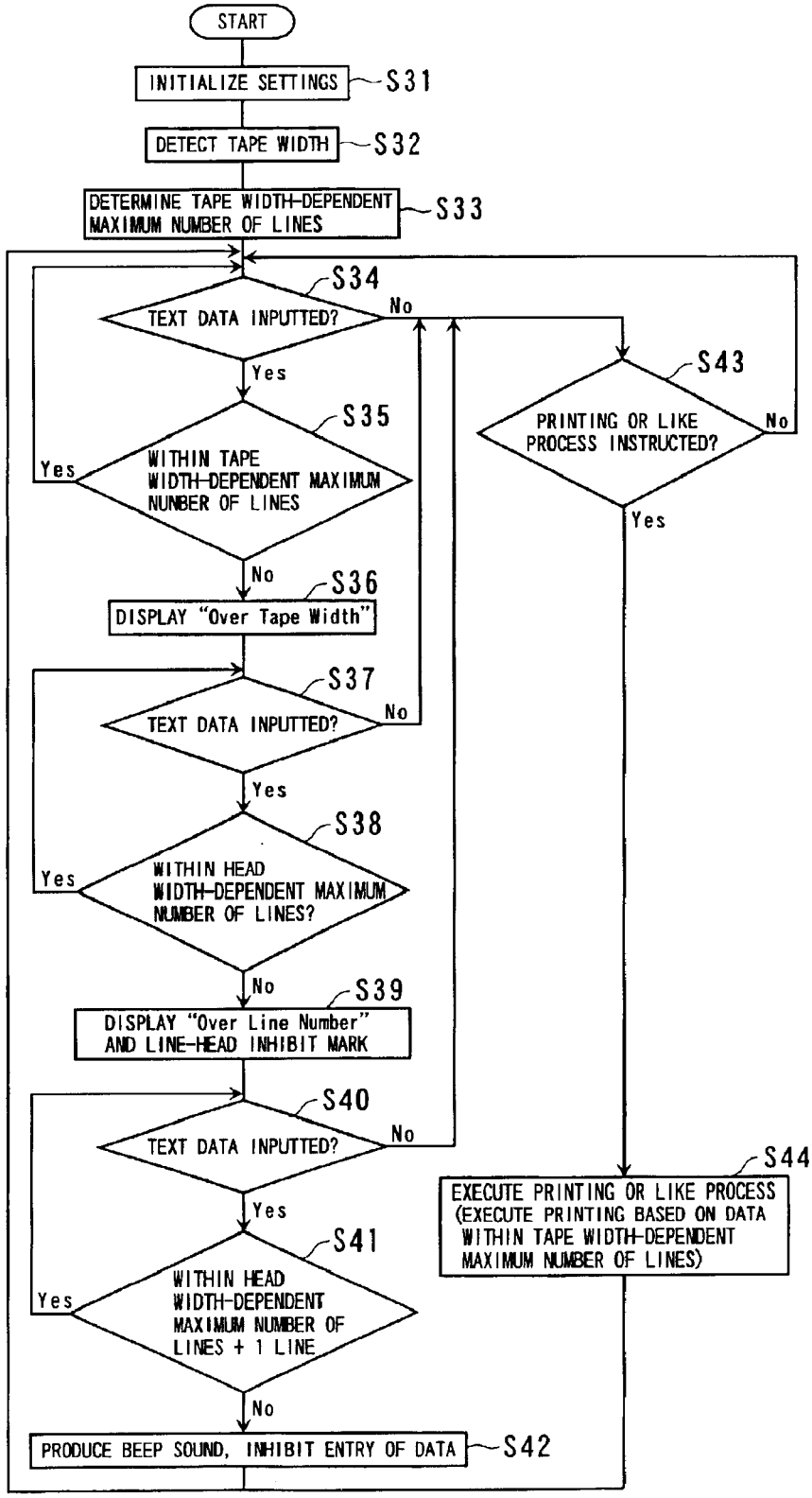
FIG. 9 is a flowchart useful in explaining an overall flow of a third example of the data input processing method according to the embodiment.

Next, a case in which data input processing is controlled based on both of the width of a tape and the width of a print head will be described as a third example of the present embodiment with reference to FIGS. 9 and 10. In this example, the tape set for use has a width of 24 mm, and hence description is given assuming that the maximum printable number of lines determined based on the tape width (first maximum printable number of lines; hereinafter referred to as "the tape width-dependent maximum number of lines") is ten (see FIG. 14A), and the maximum printable number of lines determined based on the width of the print head (second maximum printable number of lines; hereinafter referred to as "the head width-dependent maximum number of lines") is thirteen (see FIG. 14B).

When the power is turned on by the user, the initialization of the system is carried out in a step S31, and the width of the tape T is detected by the tape width-detecting sensor 142 in a step S32. The tape width-dependent maximum number of lines (ten, in this example) is determined based on the detected tape width in a step S33. Next, when text data is inputted by the user (Yes to S34, see D26 in FIG. 10), it is determined in a step S35 whether or not the inputted text data is within the tape width-dependent maximum number of lines. In this case, also in the present example, it is assumed that the number of characters (amount of data) printable in one line is not limited, and that whether or not the inputted text data is within the tape width-dependent maximum number of lines and the head width-dependent maximum number of lines is determined by counting the number of depressions of the new line start key in one text. Accordingly, here, if the new line start key has been depressed ten or more times [No to S35, when the new line start key is depressed in a state of D26 in FIG. 10 (i.e. with the cursor K being attached to text data on a tenth line), i.e. when data in excess of the tape width-dependent maximum number of lines is recognized], an error message is displayed to notify the user that the inputted text data has exceeded the tape width. This notification of the error is carried out by displaying the phrase "Over Tape Width" in half-tone dot meshing and flashing text (see D27 in FIG. 10).

Then, when text data is further inputted (Yes to S37), it is determined in a step S38 whether or not the text data is within the head width-dependent maximum number of lines (thirteen lines). Therefore, here, if the new line start key has been depressed thirteen or more times (when data in excess of the head width-dependent maximum number of lines is recognized) (No to S38), an error message to notify the user that the inputted text data has exceeded the maximum number of lines and the aforementioned line-head inhibit mark is displayed in a step S39. This notification of the error is carried out by displaying the phrase "Over Line Number" in half-tone dot meshing and flashing text, and displaying the line-head inhibit mark as a line head-indicating mark with a white background, different in background color from that of the other line (see D28 in FIG. 10).

Next, when text data is further inputted (Yes to S40), it is determined in a step S41 whether or not the inputted text data is within the head width-dependent maximum number of lines+one line (=fourteen lines). The head width-dependent maximum number of lines+one (line) is the maximum number of lines displayable on the display screen 45 (maximum displayable number of lines). Therefore, here, if the new line start key has been depressed fourteen or more times (No to S41 , when the new line start key is depressed in a state of D29 in FIG. 10), the beep sound is generated while temporarily making the inputted text data undisplayable on the display and inputting of text data is inhibited, in a step S42 (see D30 in FIG. 10). Further, if a key other than the keys used for inputting text data is depressed in the step S34, S37, or S40, (if a printing or like process is instructed in a step S43), the process is carried out in accordance with the instruction in a step S44. It should be noted that the printing process in this example is carried out based on data within the tape width-dependent maximum number of lines. In other words, even if data has been inputted in excess of the tape width-dependent maximum number of lines, the excessive data (data of "UVWXY" et seq.) is not reflected in printing.

Figure 11:
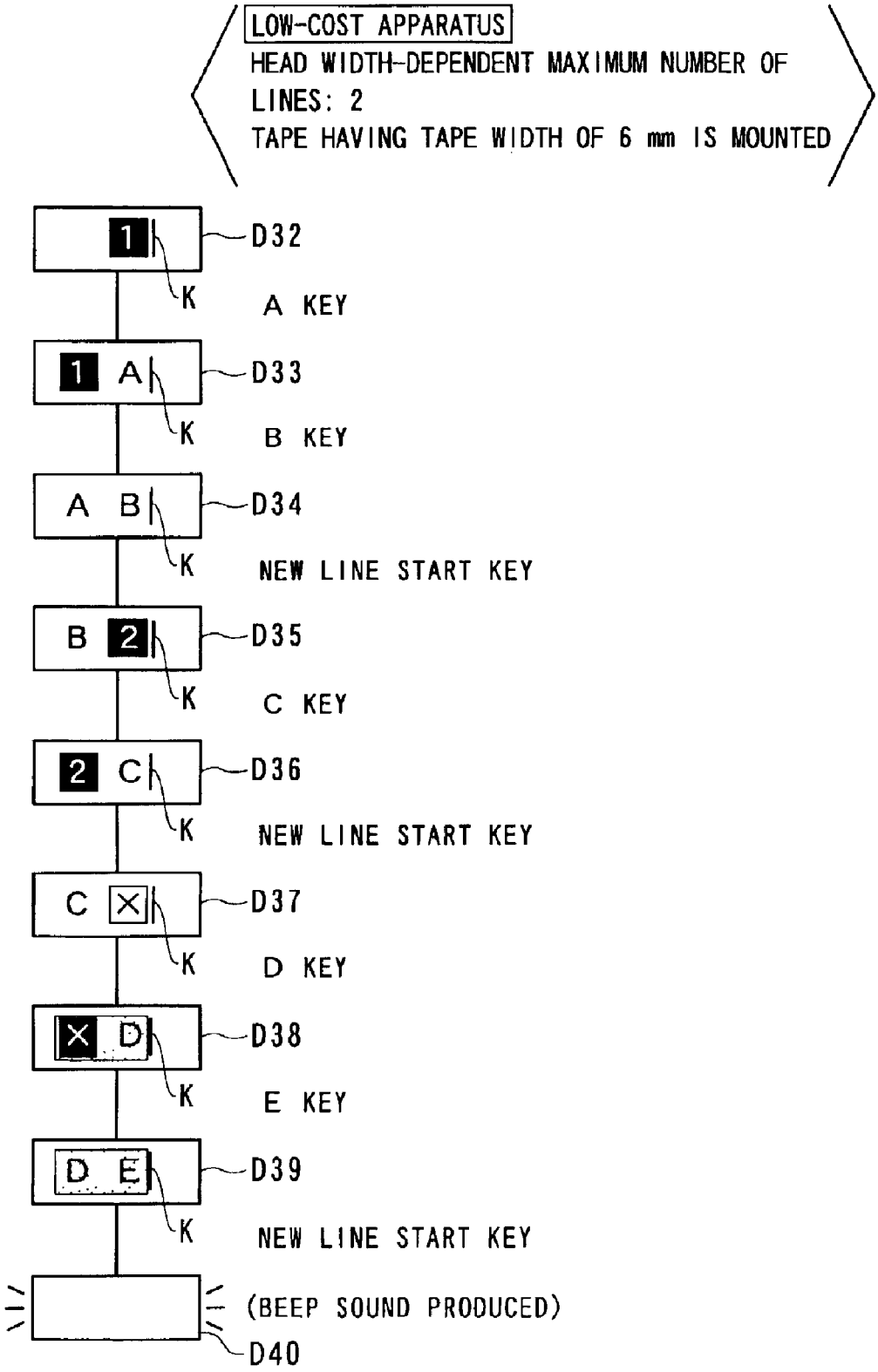
FIG. 11 is a diagram similar to FIG. 6, which is useful in explaining another variation of the third example of the embodiment, using images displayed on the display screen.

Next, a variation of the third example of the present embodiment will be described with reference to FIG. 11. This variation is directed to a low-cost tape printing apparatus. As shown in FIG. 11, in this variation, a tape printing apparatus is employed by way of example, which has a display screen for displaying only one line by three characters, and at the same time has a head width-dependent maximum number of two lines. Accordingly, in the present example, the maximum displayable number of lines are three lines, as a total of two lines as the maximum printable number of lines and one line as a predetermined number of lines (edit area).

Further, in this variation, there exist no areas for displaying a phrase indicative of information of an error, differently form the above examples (in the present example, inputted text data cannot be displayed if an error message is displayed), so that the method of notification of an error is different from the methods employed in the above examples. Further, the cursor K is displayed not under text to be edited but on a right side of inputted text data by a vertical line. As described above, by displaying the cursor K on the right side of an element of text (character) to be edited, by using the vertical line, it is possible to understandably indicate which character should be deleted in deleting an immediately preceding character (by carrying out a backspacing process) [when the cursor K is displayed under an element of text (character), it is sometimes difficult to grasp whether the character itself or a character immediately before the character is to be deleted]. It should be noted that in the present example, description is given assuming that the tape width-dependent maximum number of lines is equal to two since the tape employed has a tape width of 6 mm (see FIG. 14A).

First, after characters "A", "B" have been inputted by the user (see D33, D34) with a line head-indicating mark for a first line being displayed (see D32), when the new line start key is depressed, the character "B" and a line head-indicating mark for a second line are displayed (see D35). Here, when a character "C" is entered and the new line start key is depressed (see D36), the inputted text data exceeds the tape width-dependent maximum number of lines (two lines), and hence the line-head inhibit mark is displayed (see D37). It should be noted that at this time, the line-head inhibit mark is in black against a white background so as to allow discrimination from the other lines.

Then, when a character "D" is inputted by the user, the line-head inhibit mark is reversely displayed in white against a black background, and the character "D" is displayed in half-tone dot meshing (see D38) since the character "D" is in excess of the tape width-dependent maximum number of lines. Further, a character "E" inputted after the character "D" is similarly displayed in half-tone dot meshing (see D39). In short, display in the half-tone dot meshing is carried out to indicate that the character(s) inputted and displayed in half-tone dot meshing is (are) not to be printed on the tape. When a third depression of the new line start key is made by the user, the text data is temporarily made undisplayable on the display screen, and a beep sound is generated. At the same time, the inputting of data is inhibited (see D40). As described above, when a reduced number of lines can be displayed, the display in half-tone dot meshing makes it possible to clearly notify the user of an error without obstructing visual recognition of inputted text. It should be noted that an error may be displayed not in half-tone dot meshing but in flashing text.

Figure 12:
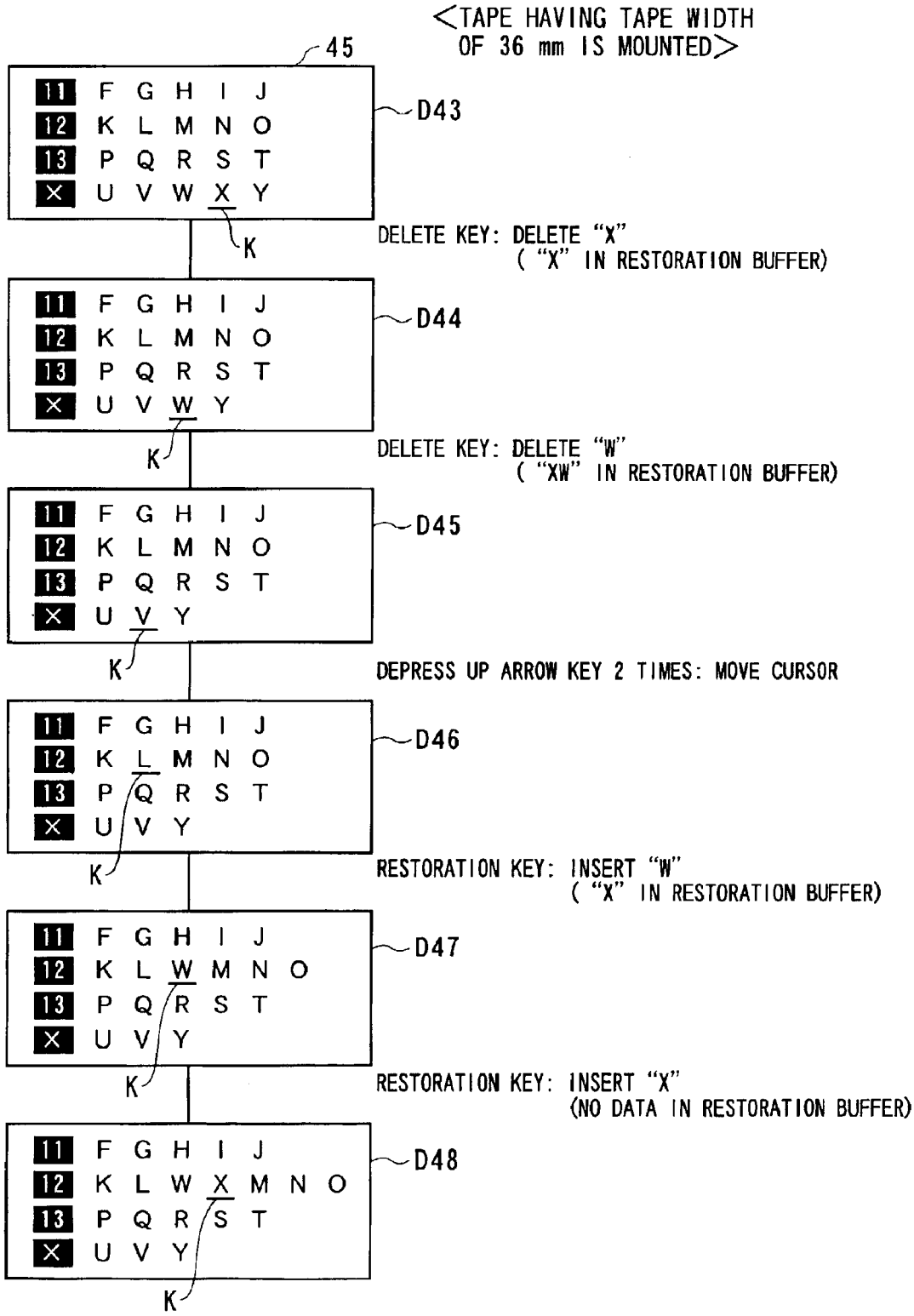
FIG. 12 is a diagram similar to FIG. 6, which is useful in explaining an applied example of the third example of the embodiment, using images displayed on the display screen.
Figure 13:
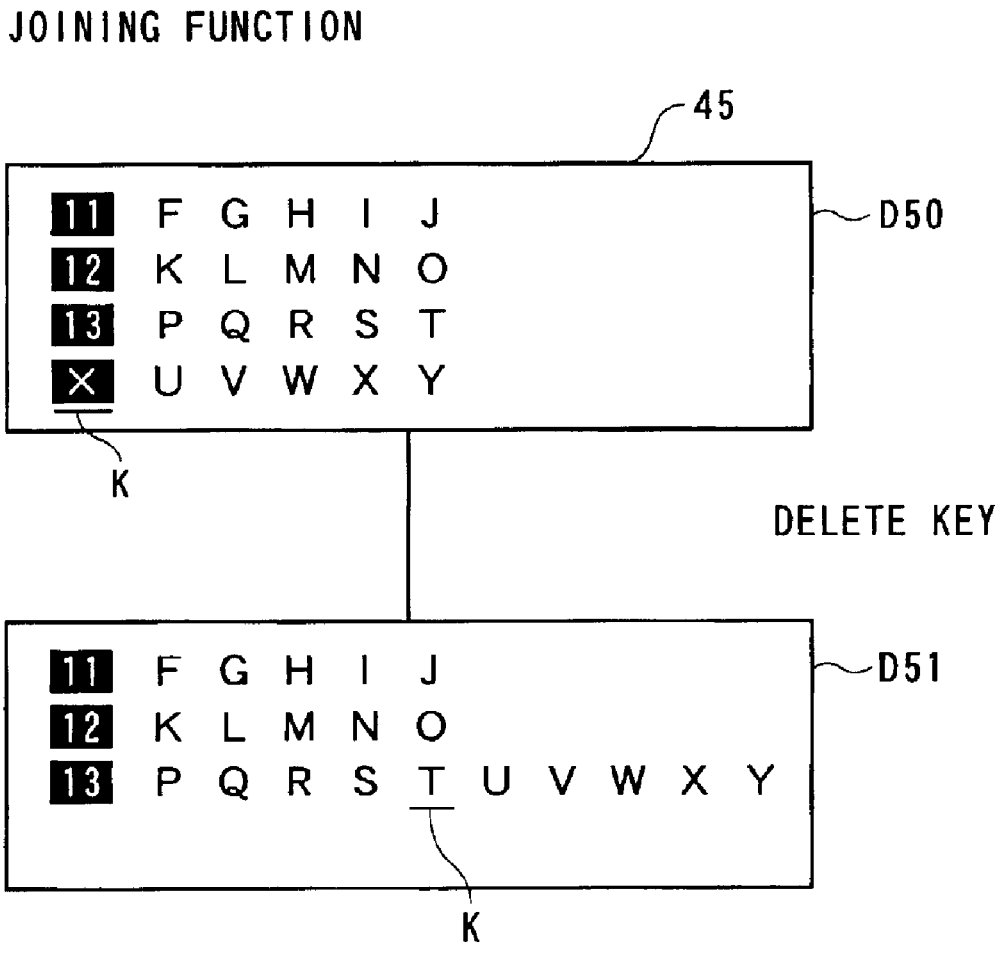
FIG. 13 is a diagram similar to FIG. 6, which useful in explaining another applied example of the third example of the embodiment, using images displayed on the display screen.

Next, applied examples of the third example of the embodiment will be described with reference to FIGS. 12 and 13. The applied examples make better use of text data inputted in the edit area, thereby enhancing the operability of the apparatus 1 in inputting data. First, a "cut & paste" function is described with reference to FIG. 12. Now, the following description is given assuming that the width of a tape in use is 36 mm and hence the tape width-dependent maximum number of lines and the head width-dependent maximum number of lines are thirteen lines (see FIGS. 14A and 14B).

When the delete key is depressed with the cursor K being attached to text data (character) "X" in the edit area (fourteenth line) (see D43) (to cut the text data "X"), the text data "X" is stored in the restoration buffer in the conversion buffer areas 247 in the RAM. Similarly, then, when the delete key is depressed with the cursor K being attached to text data (character) "W" in the edit area (fourteenth line) (see D44), the text data "W" is stored in the restoration buffer. At this time, the cursor K is attached to text data "V" one character before the text data "W".

Next, to move the cursor K to a position for pasting the text data "W", the up arrow key is depressed two times (see D46), and then the restoration key is depressed to paste the text data "W" having been stored in the restoration buffer to the position where the cursor K has been attached (see D47). At this time, there remains the text data "X" in the restoration buffer. Therefore, when the restoration key is further depressed, the text data "X" having been stored in the restoration buffer is pasted to the position where the cursor K has been attached (see D48). Now, there remains no text data in the restoration buffer. As described above, whenever the restoration key is depressed, text data having been stored in the restoration buffer is pasted in a reverse order.

It should be noted that similarly to the ordinary word processor or the like, it is possible to delete (cut) a plurality of text data items (characters) to paste them in the order in which they were arranged before being deleted. Further, in this case, it is possible to repeatedly paste the stored text data a plurality of times. Further, a "copy & paste" function can also be employed in place of the "cut & paste" function.

Furthermore, this applied example may be configured such that not only text data in the edit area (fourteenth line) but also text data within the maximum printable number of lines (first to thirteenth lines), other than the edit area, can be cut.

Next, a "joining" function will be described with reference to FIG. 13. In the following description as well, it is assumed that the width of a tape in use is 36 mm, and hence the tape width-dependent maximum number of lines and the head width-dependent maximum number of lines are thirteen (see FIGS. 14A and 14B).

When the delete key is depressed with the cursor K being attached to a line head-indicating mark for the edit area (fourteenth line) (see D50), the text data "UVWXY" in the edit area is joined to the end of text data on the last line of the maximum printable number of lines (see D51). Further, the applied example may be configured such that not only text data in the edit area (fourteenth line) but also other text data within the maximum printable number of lines (first to thirteenth lines) can be joined.

As described above as the third example of the present embodiment, of inputted data, not only data within the head width-dependent maximum number of lines determined based on the width of the print head but also data for one line in excess of the head width-dependent maximum number of lines can be displayed. In other words, the area for displaying the one line can be used as the edit area for trial input or the like, which contributes to enhancement of the operability of the apparatus in inputting data.

Further, of inputted data, only data recognized to be within the tape width-dependent maximum number of lines is printed on the tape T. More specifically, printing is carried out after determination of whether or not the inputted data can be printed on a tape in actual use, which makes it possible to prevent occurrence of a problem that the print head is damaged due to execution of erroneous printing beyond the width of the tape.

Further, as described above as the applied examples, prevision of the "cut & paste" function and the "joining" function makes it possible to effectively use data in the edit area, which constitute to further enhancement of the operability of the apparatus.

As described hereinbefore, according to the tape printing apparatus and data input processing method of the present invention, of inputted data, not only data within the maximum printable number of lines determined based on the width of a tape or the width of a print head but also data of a predetermined number of lines in excess of the maximum printable number of lines can be displayed. That is, the area for displaying the above predetermined number of lines can be used as an edit area for trial input of data or the like. This makes it possible to enhance the operability of the apparatus in inputting data.

Further, when text data is inputted in excess of the maximum printable number of lines or the maximum displayable number of lines (=maximum printable number of lines determined based on the width of a print head+one line, in the above examples) determined based on the width of a tape or the width of a print head, by notifying the user of an error as required, it is possible to cause the user to be aware that he is carrying out useless input (inputting of data which is not printed on the tape T or data which is not displayed on the display screen 45).

Further, when the maximum printable number of lines is determined based on a tape width, printing is carried out on only data printable on a tape in actual use. This makes it possible to prevent occurrence of a problem that the print head is damaged due to execution of erroneous printing beyond the width of the tape.

Although in the above examples, it is assumed that whether or not inputted data is within the maximum printable number of lines is determined based on whether or not the number of executions of new line-starting operation is equal to or smaller than a number corresponding to the maximum printable number of lines, this is not limitative, but if the amount of data (number of characters) printable on one line is determined beforehand, the determination may be made depending on whether or not the inputted data is within the maximum amount of data obtained by multiplying the amount of data printable on one line by the maximum printable number of lines.

More specifically, when a tape (which has been cut off into a short strip) having a fixed length is used, the number of characters printable on one line is limited. For example, when a tape which only allows inputting of maximum ten full-size (em-size) characters for one line is used, it is judged that characters start to be inputted on a second line when an eleventh character is inputted. Therefore, assuming that the maximum printable number of lines is two lines, if the number of characters in excess of twenty characters have been inputted, error notification is carried out to the effect that the inputted text data has exceeded the maximum tape width. According to this configuration, the data input processing method of the present invention can also be applied to a tape having a fixed length. In this case, it is preferred that whether or not inputted text data is within the maximum printable number of lines is determined by counting not only the number of characters but also the number of depressions of the new line start key (by taking both of the amount of data input and the number of depressions of the new line start key into account).

Figure 10:
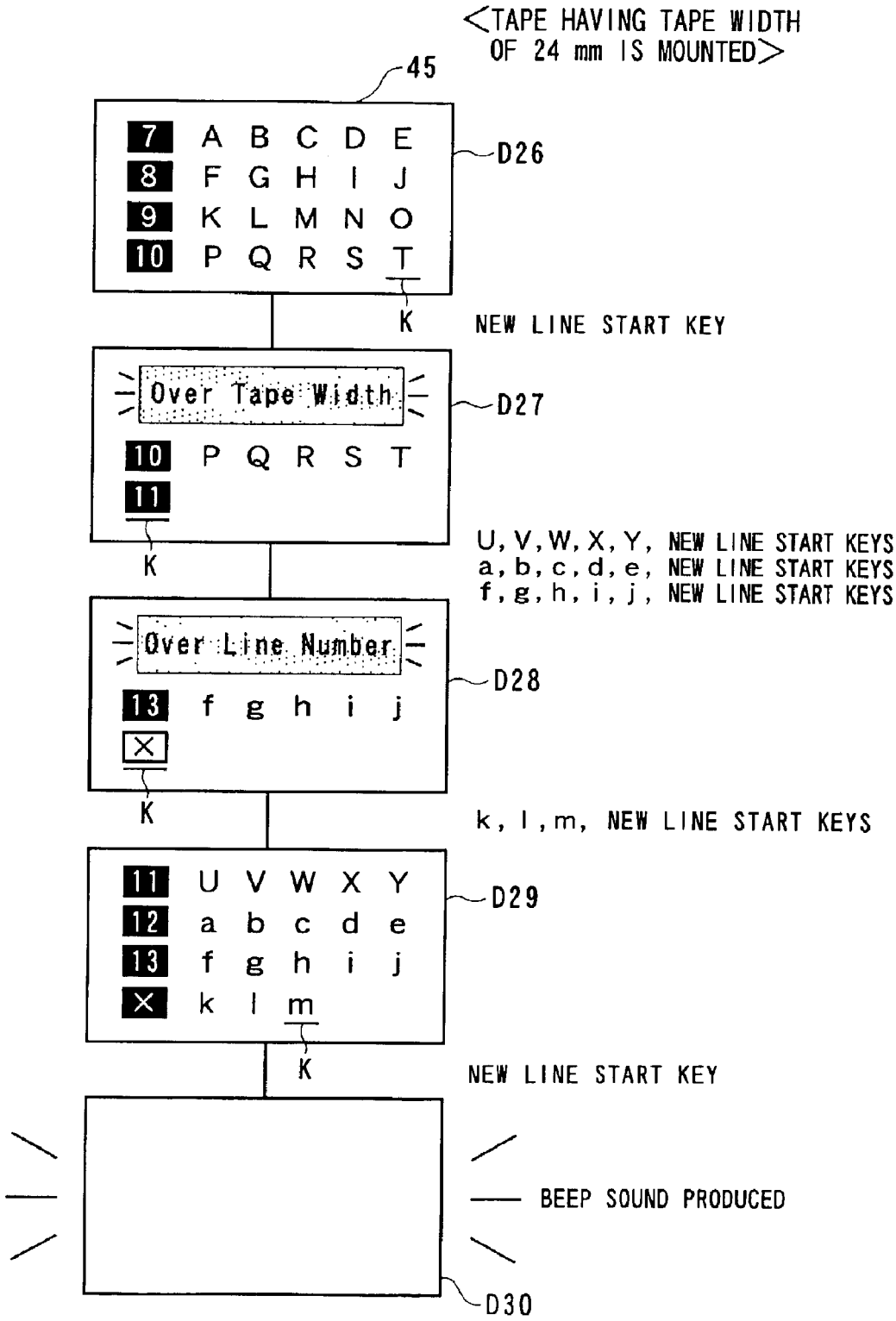
FIG. 10 is a diagram useful in explaining the third example of the data input processing method according to the embodiment, using images displayed on the display screen.

Although in the above embodiment, for example, in the case of FIG. 10 or the like, it is assumed that the phrase "Over Tape Width" is displayed (see D26, D27) when the new line start key is depressed with the cursor K being attached to the last line of the maximum printable number of lines (tape width-dependent maximum number of lines (ten lines)) determined based on the tape width, this is not limitative, but when the new line start key is depressed, a line head-indicating mark for the next line (eleventh line) may be displayed in black against a white background, and when another character is inputted thereafter, the line head-indicating mark may be reversely displayed in white against a black background together with the phrase "Over Tape Width". In short, the error notification is not carried out when the new line start key is depressed, but may be carried out, only after a character is inputted in the eleventh line, judging that data in excess of the maximum printable number of lines has been inputted.

Further, the phrase "Over Tape Width" may not be temporarily displayed but may be continuously displayed on the display screen when data in excess of the first maximum printable number of lines is being inputted (when data is being inputted to the eleventh line et seq. in FIG. 10). According to this configuration, it is possible to cause the user to be conscious of his being inputting data in excess of the tape width (data which is not actually printed on the tape). The displayed phrase may be "Over Line Number" or any other suitable phrase instead of "Over Tape Width".

Further, in the above case, the fact that data in excess of the first maximum printable number of lines is being inputted may be displayed by using an indicator or the like in place of the phrases. According to this configuration, no large area is required for displaying an error message for notifying the user of an error. This makes it possible to clearly notify the user of occurrence of the error without obstructing visual recognition of inputted text data.

Although in the above embodiments, the tape width is detected by sensing the plurality of small holes 35 formed in the bottom of the cartridge casing 51 by using the tape width-detecting sensor 142, and the maximum printable number of lines (tape width-dependent maximum number of lines) is determined according to the result of the detection, this is not limitative, but based on a tape width set (inputted) by the user, the maximum printable number of lines may be determined. Further, the apparatus may be configured such that information as to the width of a tape is stored in the barcode tape BT (see FIGS. 15A to 15C) affixed to the bottom surface of the cartridge casing 51, and detected by the tape information-detecting sensor 143, for determination of the maximum printable number of lines. According to these configurations, it is possible to simplify the construction of the apparatus, since there is no need to provide the tape width-detecting sensor 142.

Further, although in the above embodiment, the cases in which data in excess of the maximum printable number of lines is displayed in half-tone dot meshing and flashing text are described by way of example of the display of an error, this is not limitative, but the error may be notified by displaying data in excess of the maximum printable number of lines in a visually different display mode from a display mode for displaying data within the maximum printable number of lines. It should be noted that the different display mode may be any suitable display mode which enables the data in excess of the maximum printable number of lines to be visually distinguished from the data within the maximum printable number of lines, e.g. through decoration, or change in typeface, color or size of a character. According to this configuration, there is no need to provide an area for displaying an error, and even if the display screen is capable of displaying only one line, it is possible to notify an error while displaying inputted data. Further, it is possible to notify the user of various types of errors since the display can be carried out in various manners depending on information of each error.

Further, although in the above example, the edit area is assumed to be one line on the display screen, this is not limitative, but the edit area may occupy an area corresponding to two or more lines on the display screen. This configuration makes it possible to secure a large edit area, thereby further enhancing the operability of the apparatus.

It is further understood by those skilled in the art that the foregoing is a preferred embodiment of the invention, and that various changes and modifications may be made without departing from the spirit and scope thereof.

What is claimed is:

1. A tape printing apparatus that is capable of printing one to a plurality of predetermined maximum printable number of lines on a tape based on inputted data, the tape printing apparatus comprising:

input means for inputting data;

data-recognizing means for recognizing the data inputted by said input means in a manner distinguishing between data within the maximum printable number of lines and data in excess of the maximum printable number of lines;

display means for displaying, of the data inputted by said input means, not only the data recognized to be within the maximum printable number of lines by said data-recognizing means, but also data corresponding to a predetermined number of lines in excess of the maximum printable number of lines as data in an edit area; and printing means for printing, of the data inputted by said input means, data other than the data in the edit area;

wherein said display means displays, when the data in the edit area is inputted by said input means, the data in the edit area in a different display mode from a display mode for displaying the data within the maximum printable number of lines.

2. A tape printing apparatus according to claim 1, further comprising means for unconditionally determining the maximum printable number of lines based on a width of the tape.

3. A tape printing apparatus according to claim 1, including a print head, and wherein the maximum printable number of lines is unconditionally determined based on a width of the print head.

4. A tape printing apparatus according to claim 1, further comprising error notification means for notifying a user of occurrence of an error when the data in excess of the maximum printable number of lines is recognized by said data-recognizing means.

5. A tape printing apparatus according to claim 4, wherein said error notification means notifies the user of occurrence of the error by making an electronic sound.

6. A tape printing apparatus according to claim 4, wherein said error notification means notifies the user of occurrence of the error by causing said display means to display characters to the effect that the inputted data has exceeded the maximum printable number of lines.

7. A tape printing apparatus according to claim 4, wherein said error notification means notifies the user of occurrence of the error by causing said display means to display the data of the predetermined number of lines in excess of the maximum printable number of lines in a different display mode from a display mode for displaying the data within the maximum printable number of lines.

8. A tape printing apparatus according to claim 7, wherein said error notification means notifies the user of occurrence of the error by causing said display means to display the data of the predetermined number of lines in excess of the maximum printable number of lines in either half-tone dot meshing or flashing text or in combination of half-tone dot meshing and flashing text.

9. A tape printing apparatus according to claim 7, wherein said display means is configured to display line head-indicating marks for respective lines, and wherein said error notification means notifies the user of occurrence of the error by displaying ones of the line head-indicating marks attached to the data of the predetermined number of lines in excess of the maximum printable number of lines in a different display mode from a display mode for displaying ones of the line head-indicating marks attached to the data within the maximum printable number of lines.

10. A tape printing apparatus according to claim 1, further comprising input-inhibiting means for inhibiting inputting of data when the data inputted by said input means has exceeded a number of lines determined by adding the predetermined number of lines to the maximum printable number of lines.

11. A tape printing apparatus according to claim 10, further comprising error notification means for notifying a user of occurrence of an error when the inputting of data is inhibited by said input-inhibiting means.

12. A tape printing apparatus according to claim 11, wherein said error notification means notifies the user of occurrence of the error by temporarily stopping said display means from performing display.

13. A tape printing apparatus according to claim 1, wherein said input means is capable of cutting or copying part of the data of the predetermined number of lines in excess of the maximum printable number of lines to paste the part of the data into the data within the maximum printable number of lines.

14. A tape printing apparatus according to claim 1, wherein said display means is capable of displaying line head-indicating marks for respective lines, and is configured to add a cursor to a portion for operation, and wherein said input means is capable of joining the data in excess of the maximum printable number of lines to an end of data on a last line within the maximum printable number of lines, when data-deleting operation is carried out with the cursor being attached to a first one of the line head-indicating marks for the data in excess of the maximum printable number of lines.

15. A tape printing apparatus according to claim 1, wherein the data of the predetermined number of lines in excess of the maximum printable number of lines is further comprised of one line.

16. A tape printing apparatus that includes a print head and is capable of printing one to a plurality of lines on a tape based on inputted data, the tape printing apparatus comprising:

input means for inputting data;

first data-recognizing means for recognizing the data inputted by said input means in a manner distinguishing between data within a first maximum printable number of lines unconditionally determined based on a width of a tape and data in excess of the first maximum printable number of lines;

second data-recognizing means for recognizing the data inputted by said input means in a manner distinguishing between data within a second maximum printable number of lines unconditionally determined based on a width of the print head and data in excess of the second maximum printable number of lines;

display means for displaying, of the data inputted by said input means, not only the data recognized to be within the second maximum printable number of lines by said second data-recognizing means but also data of a predetermined number of lines in excess of the second maximum printable number of lines; and printing means for printing, of the data inputted by said input means, only the data recognized to be within the first maximum printable number of lines by said first data-recognizing means, on the tape.

17. A tape printing apparatus according to claim 16, further comprising:

first error notification means for notifying a user of occurrence of an error when the data in excess of the first maximum printable number of lines is recognized by said first data-recognizing means, and second error notification means for notifying the user of occurrence of an error when the data in excess of the second maximum printable number of lines is recognized by said second data-recognizing means, and wherein said first error notification means and said second error notification means notify the user of occurrence of the errors in respective manners different from each other.

18. A tape printing apparatus according to claim 17, wherein one of said first error notification means and said second error notification means notifies the user of occurrence of a corresponding one of the errors by making an electronic sound.

19. A tape printing apparatus according to claim 17, wherein said first error notification means and said second error notification means notify the user of occurrence of the errors by making respective electronic sounds different from each other.

20. A tape printing apparatus according to claim 17, wherein one of said first error notification means and said second error notification means notifies the user of occurrence of a corresponding one of the errors by causing said display means to display characters to the effect that the inputted data has exceeded a corresponding one of the first maximum printable number of lines and the second maximum printable number of lines.

21. A tape printing apparatus according to claim 17, wherein said first error notification means and said second error notification means each notify the user of occurrence of a corresponding one of the errors by causing said display means to display characters to the effect that the inputted data has exceeded a corresponding one of the first maximum printable number of lines and the second maximum printable number of lines.

22. A tape printing apparatus according to claim 17, wherein one of said first error notification means and said second error notification means notifies the user of occurrence of a corresponding one of the errors by causing said display means to display the data in excess of a corresponding one of the first maximum printable number of lines and the second maximum printable number of lines in a different display mode from a mode for displaying the data within the corresponding one of the first maximum printable number of lines and the second maximum printable number of lines.

23. A tape printing apparatus according to claim 17, wherein said first error notification means and said second error notification means notify the user of occurrence of the errors by causing said display means to display the data in excess of the first maximum printable number of lines and the data in excess of the second maximum printable number of lines in respective display modes which are different from a display mode for displaying the data within the first maximum printable number of lines, and at the same time different from each other.

24. A tape printing apparatus according to claim 16, further comprising input-inhibiting means for inhibiting data from being inputted when the data inputted by said input means has exceeded a number of lines determined by adding the predetermined number of lines to the second maximum printable number of lines.

25. A tape printing apparatus according to claim 24, further comprising error notification means for notifying the user of occurrence of an error when the inputting of data is inhibited by said input-inhibiting means.

26. A tape printing apparatus according to claim 25, wherein said error notification means notifies the user of occurrence of the error by temporarily stopping said display means from performing display.

27. A data input processing method for a tape printing apparatus that is capable of printing one to a plurality of predetermined maximum printable number of lines on a tape based on inputted data, the method comprising the steps of:

inputting data;

recognizing the data inputted in the inputting step in a manner distinguishing between data within the maximum printable number of lines and data in excess of the maximum printable number of lines;

displaying, of the data inputted in the inputting step, not only the data recognized to be within the maximum printable number of lines by said data-recognizing means, but also data corresponding to a predetermined number of lines in excess of the maximum printable number of lines as data in an edit area; and printing, of the data inputted in the inputting step, data other than the data in the edit area;

wherein in the displaying step, when the data in the edit area is inputted by said input means, the data in the edit area is displayed in a different display mode from a display mode for displaying the data within the maximum printable number of lines.

28. A data input processing method according to claim 27, further comprising the step of unconditionally determining the maximum printable number of lines based on a width of a tape.

29. A data input processing method according to claim 27, further comprising the step of unconditionally determining the maximum printable number of lines based on a width of a print head.

30. A data input processing method for a tape printing apparatus that includes a print head and is capable of printing on one to a plurality of lines on a tape based on inputted data, the data input processing method comprising the steps of:

inputting data;

recognizing the data inputted in the inputting step in a manner distinguishing between data within a first maximum printable number of lines unconditionally determined based on a width of a tape and data in excess of the first maximum printable number of lines;

recognizing the data inputted in the inputting step in a manner distinguishing between data within a second maximum printable number of lines unconditionally determined based on a width of the print head and data in excess of the second maximum printable number of lines;

displaying, of the data inputted in the inputting step, not only the data recognized to be within the second maximum printable number of lines by the second-mentioned recognizing step but also data of a predetermined number of lines in excess of the second maximum printable number of lines; and printing, of the data inputted in the inputting step, only the data recognized to be within the first maximum printable number of lines by said first-mentioned recognizing step, on the tape.

31. A tape printing apparatus that is capable of printing one to a plurality of predetermined maximum printable number of lines on a tape based on inputted data, the tape printing apparatus comprising:

input means for inputting data;

data-recognizing means for recognizing the data inputted by said input means in a manner distinguishing between data within the maximum printable number of lines and data in excess of the maximum printable number of lines; and display means for displaying, of the data inputted by said input means, not only the data recognized to be within the maximum printable number of lines by said data-recognizing means, but also data corresponding to a predetermined number of lines in excess of the maximum printable number of lines as data in an edit area;

wherein said display means displays, when the data in the edit area is inputted by said input means, the data in the edit area in a different display mode from a display mode for displaying the data within the maximum printable number of lines, and displays, when the data within the edit area is joined into the data within the maximum printable number of lines, the data within the edit area in a display mode same as the display mode for the data within the maximum printable number of lines.

32. A tape printing apparatus according to claim 31, further comprising means for unconditionally determining the maximum printable number of lines based on a width of the tape.

33. A tape printing apparatus according to claim 31, including a print head, and wherein the maximum printable number of lines is unconditionally determined based on a width of the print head.

34. A tape printing apparatus according to claim 31, further comprising error notification means for notifying a user of occurrence of an error when the data in excess of the maximum printable number of lines is recognized by said data-recognizing means.

35. A tape printing apparatus according to claim 31, further comprising input-inhibiting means for inhibiting inputting of data when the data inputted by said input means has exceeded a number of lines determined by adding the predetermined number of lines to the maximum printable number of lines.

36. A tape printing apparatus according to claim 31, wherein said input means is capable of: cutting or copying part of the data of the predetermined number of lines in excess of the maximum printable number of lines to paste the part of the data into the data within the maximum printable number of lines.

37. A tape printing apparatus according to claim 31, wherein said display means is capable of displaying line head-indicating marks for respective lines, and is configured to add a cursor to a portion for operation, and wherein said input means is capable of joining the data in excess of the maximum printable number of lines to an end of data on a last line within the maximum printable number of lines, when data-deleting operation is carried out with the cursor being attached to a first one of the line head-indicating marks for the data in excess of the maximum printable number of lines.

38. A tape printing apparatus according to claim 31, wherein the data of the predetermined number of lines in excess of the maximum printable number of lines is further comprised of one line.

39. A data input processing method for tape printing apparatus that is capable of printing one to a plurality of predetermined maximum printable number of lines on a tape based on inputted data, the method comprising the steps of:

inputting data;

recognizing the data inputted by the inputting step in a manner distinguishing between data within the maximum printable number of lines and data in excess of the maximum printable number of lines; and displaying, of the data inputted by the inputting step, not only the data recognized to be within the maximum printable number of lines by said data-recognizing means, but also data corresponding to a predetermined number of lines in excess of the maximum printable number of lines as data in an edit area;

wherein in the displaying step, when the data in the edit area is inputted by said input means, the data in the edit area is displayed in a different display mode from a display mode for displaying the data within the maximum printable number of lines and, when the data within the edit area is joined into the data within the maximum printable number of lines, the data within the edit area is displayed in a display mode same as the display mode for the data within the maximum printable number of lines.

40. A data input processing method according to claim 39, further comprising the step of unconditionally determining the maximum printable number of lines based on a width of a tape.

41. A data input processing method according to claim 39, further comprising the step of unconditionally determining the maximum printable number of lines based on a width of a print head.

* * * * *